United States Patent [19]

Jeppson

[11] 4,319,856

[45] Mar. 16, 1982

[54] MICROWAVE METHOD AND APPARATUS FOR REPROCESSING PAVEMENTS

[75] Inventor: Morris R. Jeppson, Carmel, Calif.

[73] Assignees: Microdry Corportion, San Ramon; Giselle V. Laurmann, Carmel, both of Calif.; Richard R. Blurton; Claire M. Blurton, both of Incline Village, Nev. ; part interest to each

[21] Appl. No.: 948,503

[22] Filed: Oct. 4, 1978

Related U.S. Application Data

[63] Continuation of Ser. No. 756,365, Jan. 3, 1977.

[51] Int. Cl.[3] ..... E01C 23/14

[52] U.S. Cl. ..... 404/79; 404/95; 404/92; 299/14; 219/10.69

[58] Field of Search ..... 404/95, 90, 91, 92, 404/101, 84, 77, 79; 126/271.1, 275 E; 328/7; 299/14; 219/10.69

[56] References Cited

U.S. PATENT DOCUMENTS

| | | | |
|---|---|---|---|
| 1,399,681 | 12/1921 | Austin | 404/77 |
| 1,921,688 | 8/1933 | McLaughlin | 404/92 |
| 1,997,037 | 4/1935 | Barber | 404/92 |
| 2,159,509 | 5/1939 | Mosel | 404/92 |
| 2,169,406 | 8/1939 | Cost | 404/92 |
| 2,254,463 | 9/1941 | Wells | 404/95 |
| 2,303,812 | 12/1942 | Barber | 404/95 |
| 2,394,017 | 2/1946 | Seaman | 404/95 |
| 3,044,373 | 7/1962 | Sommer | 404/82 X |
| 3,055,280 | 9/1962 | Neville | 404/95 |
| 3,096,696 | 7/1963 | Reisser | 404/95 |
| 3,361,042 | 1/1968 | Cutler | 404/90 X |
| 3,365,562 | 1/1968 | Jeppson | 219/10.69 |
| 3,472,200 | 10/1969 | Gerling | 118/5 |
| 3,601,448 | 8/1971 | Stone | 299/14 |
| 3,825,361 | 7/1974 | Steiner | 404/90 |
| 3,843,274 | 10/1974 | Gutman | 404/91 |
| 3,874,366 | 4/1975 | Cutler | 404/95 X |
| 3,964,183 | 6/1976 | Mouat | 404/77 |
| 3,965,281 | 6/1976 | Takase | 404/82 X |
| 3,970,404 | 7/1976 | Benedetti | 404/77 |
| 4,011,023 | 3/1977 | Cutler | 404/91 |
| 4,124,325 | 11/1978 | Cutler | 404/95 X |

FOREIGN PATENT DOCUMENTS

| | | |
|---|---|---|
| 917487 | 2/1963 | United Kingdom . |
| 1096573 | 12/1967 | United Kingdom . |
| 1110021 | 4/1968 | United Kingdom . |
| 1110022 | 4/1968 | United Kingdom . |
| 1216654 | 12/1970 | United Kingdom . |
| 1226601 | 3/1971 | United Kingdom . |

OTHER PUBLICATIONS

"The Journal of Microwave Power", publication of The International Microwave Power Institute, Canada, 9(4)74.

Syracuse University Research Corp., Final Report No. TR 76-052, Mar. 1976.

California: Crook Co. Brochure, p. 23, Allatt Ltd.

C.M.I. Corp. Advertisement; "California Builder & Engineer", Apr. 14, 1978.

*Primary Examiner*—Nile C. Byers, Jr.

*Attorney, Agent, or Firm*—Phillips, Moore, Weissenberger, Lempio & Majestic

[57] ABSTRACT

Asphalt roads or the like are repaved by heating and decomposing existing pavement with microwave energy and then remixing and recompacting the constituents of the pavement, the operations being performed at the original location of the old pavement and in some cases without removing the pavement constituents from the roadbed itself. A microwave energy applicator may be traveled along the pavement in front of remixing, grading and compacting equipment or some or all of the equipment may be integrated into a self-propelled vehicle. The vehicle may carry a microwave applicator followed by remixing means such as rotary tillers or the like and grading and compaction devices, and may travel continuously down a road which is reconditioned as the vehicle progresses. Motor generator sets on the vehicle power the microwave sources and the hot exhaust from the motors may be directed to the pavement to supplement the microwave heating and to maintain high temperatures during the additional operations. Apparatus is provided for efficiently coupling microwave energy into underlying pavement and for inhibiting the escape of microwave energy from the heating region, the apparatus being useful for heat treating concrete or the like as well as asphaltic pavement.

48 Claims, 27 Drawing Figures

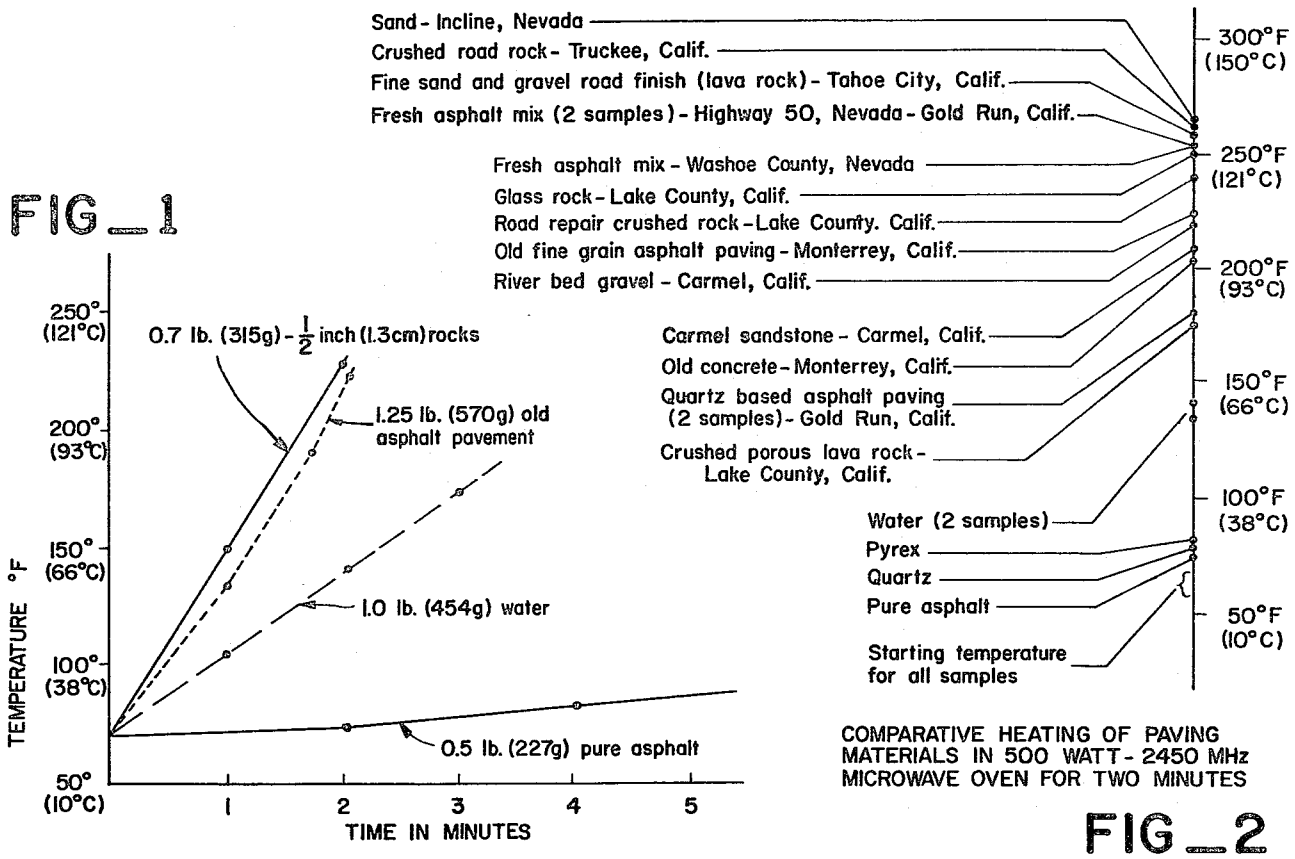
300°F (150°C)
250°F (121°C)
200°F (93°C)
150°F (66°C)
100°F (38°C)
50°F (10°C)
Sand - Incline, Nevada
Crushed road rock - Truckee, Calif.
Fine sand and gravel road finish (lava rock) - Tahoe City, Calif.
Fresh asphalt mix (2 samples) - Highway 50, Nevada - Gold Run, Calif.
Fresh asphalt mix - Washoe County, Nevada
Glass rock - Lake County, Calif.
Road repair crushed rock - Lake County, Calif.
Old fine grain asphalt paving - Monterrey, Calif.
River bed gravel - Carmel, Calif.
Carmel sandstone - Carmel, Calif.
Old concrete - Monterrey, Calif.
Quartz based asphalt paving (2 samples) - Gold Run, Calif.
Crushed porous lava rock - Lake County, Calif.
Water (2 samples)
Pyrex
Quartz
Pure asphalt
Starting temperature for all samples
COMPARATIVE HEATING OF PAVING MATERIALS IN 500 WATT - 2450 MHz MICROWAVE OVEN FOR TWO MINUTES
FIG_2
0.7 lb. (315g) - 1/2 inch (1.3cm) rocks
1.25 lb. (570g) old asphalt pavement
1.0 lb. (454g) water
0.5 lb. (227g) pure asphalt
250° (121°C)
200° (93°C)
150° (66°C)
100° (38°C)
50° (10°C)
TEMPERATURE °F
1
2
3
4
5
TIME IN MINUTES
FIG_1

FIG_9
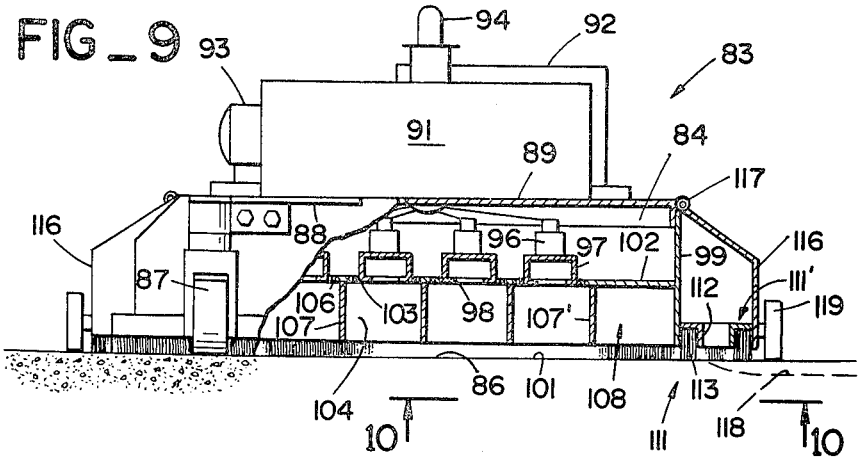
FIG_11
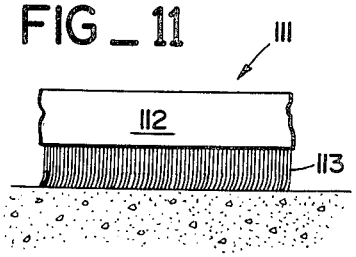
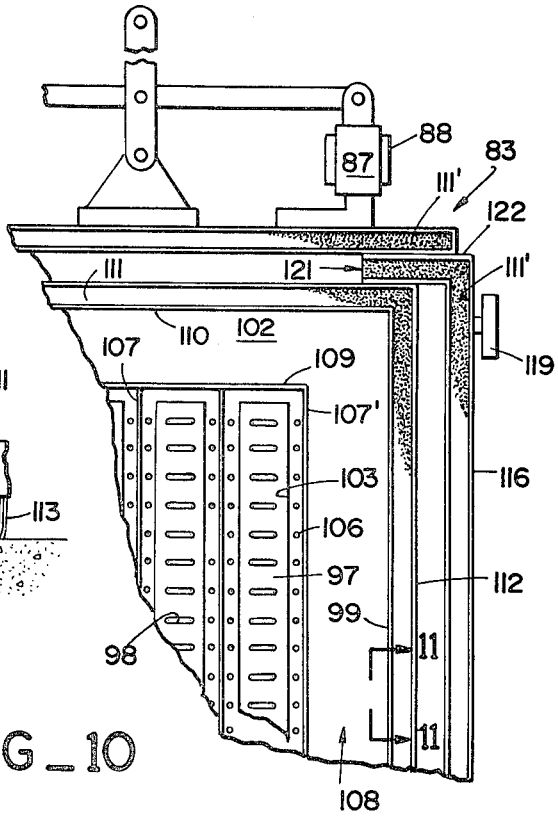
FIG_10

MICROWAVE METHOD AND APPARATUS FOR REPROCESSING PAVEMENTS

This is a continuation of Ser. No. 756,365, filed Jan. 3, 1977.

BACKGROUND OF THE INVENTION

This invention relates to the processing of pavements at roadways or the like and more particularly to a method and apparatus for more efficiently and economically repaving, repairing or heat treating pavements. In one form, the invention enables the recycling of existing asphalt roads at the roadbed using little or no new paving materials.

The introduction of the automobile as a major means of mass transportation and of automotive trucks as an important means of freight transport has been accompanied by a vast expansion of paved highway systems, roads, city streets and the like. Much of this road system is paved in whole or in part with asphaltic compositions and much of it is of fairly recent origin. Because of this historical situation, advances in asphalt paving technology have tended to be concentrated on techniques and equipment for new construction rather than on the repaving or repair of existing roads.

Asphalt pavement deterioates with age and as a result of heavy use. A variety of causes ranging from the concentrated localized stresses imposed on such pavement by heavy vehicles to ground settlement and ground water effects causes the pavement surface to become uneven, to crack and to exhibit so-called potholes in small localized areas where the pavement has for practical purposes decomposed. Repair or repaving efforts as heretofore practiced have tended to be essentially adaptations of new construction techniques. Initial repair steps typically consist of filling cracks, surface depressions and potholes with fresh new asphalt mix at the specific small areas in the pavement where this is needed. Patched areas of this kind often do not exhibit the stability and durability of the original pavement and thus repeated and usually more widespread patching becomes necessary in time. Eventually, when deterioration has progressed to a certain stage at least portions of the entire roadway may be repaved.

A typical road repaving operation of this kind has involved ripping up the old asphalt pavement which must then be loaded into trucks and transported to a dump site which is often a considerable distance away. New asphalt hot-mix is then brought in, laid in place and compacted in what is essentially a new paving operation with new material.

The fact that much of the vast existing asphalt roadway system is just now approaching a stage at which substantial repair or repaving will be needed, coupled with certain recent economic developments, is creating a potential crisis situation which has not been widely recognized until very recently.

A growing worldwide scarcity of petroleum derivative products, which includes asphalt, has very recently developed and has given rise to a substantial escalation of cost and perhaps a need to allocate the available resources of this kind between various competing needs such as energyproduction as opposed to road repair. When the high cost of new asphalt is combined with the labor, equipment and energy costs involved in repaving using known techniques, the resulting total cost figure appears to rule out any practical possibility of maintaining the vast highway system in the United States of America in a state approaching its present condition. Knowledgeable opinions have been expressed that deterioration of existing highway systems is, as a practical matter, almost a certainty. This situation will of course be further aggravated if the number of automobiles and trucks in use should be further increased as appears entirely likely.

To alleviate this situation by bringing the cost of highway repair down to a figure within the bounds of economic practicality, it has heretofore been proposed to recycle existing asphalt pavement. As heretofore contemplated and as has been carried out to a very limited extent, this involves ripping up the existing asphalt pavement on a road and transporting the chunks of old pavement to a distant processing plant where the pavement is heated to soften the asphalt. The constituents of the old pavement are then remixed. The remixed asphalt composition is then transported back to the roadway in a heated condition and utilized to repave the roadway in essentially the conventional manner.

This recycling of existing pavement realizes a substantial economy in that little or no new asphalt and aggregates is needed. An additional economic and ecological benefit arises from the fact that no dump site for old pavement may be required. Because of increasing ecological concerns and more intensive land use, suitable dump sites of this kind are becoming very difficult to find and if successfully located may be at great distances from the roadpaving site thereby further aggravating costs.

The economic savings of recycling asphalt paving in the known manner, as briefly discussed above, are largely confined to the savings realized by reducing or eliminating the need for new asphalt and aggregates. Under most circumstances at least, no substantial saving is made in the cost of transportation of materials nor in labor or equipment costs. Equipment costs at the processing plant may in fact increase somewhat as the type of apparatus used for heating new asphalt cannot usually be employed to heat recovered asphalt chunks, portions of which tend to ignite and to generate large quantities of smoke pollution if processed in the same apparatus used to prepare fresh hotmix. In one known recycling plant a specialized heat exchanger resembling a drum mixer is utilized in an arrangement which enables isolation of an external combustion chamber from the mix.

Partly to reduce ignition and pollution problems of the kind discussed above, it has very recently been proposed to use microwave energy for heating old asphalt pavement chunks at a recycling plant. Microwave energy is a flameless heating medium and is much more rapid than conventional techniques as it does not depend on conduction of heat inward from the surface of a pavement chunk but instead generates heat internally throughout the volume of the substance being heated. Use of microwave heating for such purposes is itself subject to many specialized technical problems which must be solved before such a procedure becomes practical. As one example, microwave tends to be a costly heating technique and therefore provisions must be made to assure that a high proportion of the generated microwave energy is converted into heat within the asphalt mix. As another example, it is essential that no sizable amount of microwave energy be radiated from the heating zone to the surrounding environment both for safety reasons and to avoid interference with other forms of electronic equipment such as radar systems, microwave communication links and the like. Techniques and equipment for utilizing microwave energy to heat other kinds of substance on a high-volume, continuous-process basis have heretofore been worked out, most notably in connection with the large-scale industrial processing of food products, and at least to some extent these known systems and procedures may be adaptable to reheating of used asphalt pavement in a fixed recycling plant of the kind discussed above.

Reference has been made above to the fact that the conventional repaving processes generally involve ripping up old asphalt pavement and transporting it to a dump site. Heretofore, this old asphalt pavement has not only been unutilized but has itself added substantially to the cost of a repaving operation because of the need to rip up the old pavement and the need for trucks to transport it to an often distant dump site and further because the dump site may then be rendered useless for other purposes. It has just recently been recognized that recycling of old asphalt pavement need not be confined to road or highway pavements. If practical and economic processes and equipment are available, the vast quantities of old asphalt presently occupying old dump sites can be converted to an asset. Such dump sites are essentially asphalt mines awaiting practical recovery techniques.

In general it may be said that it has just recently come to be recognized that the reuse of old asphalt pavement may not only offer sizable economies but may in fact be a practical necessity if the quality of existing road systems is to be maintained. At the same time, techniques and specialized equipment for accomplishing such recycling in a desirably efficient and economic manner have not heretofore been developed to an appreciable extent.

The foregoing discussion has dealt primarily with the economic disadvantages of prior techniques and systems for repaving or repairing asphaltic pavement. There are also other problems which are more technological than economic. One is that the bonding between new asphalt put down in cracks, low areas, potholes and the like and the older adjacent pavement tends to be relatively weak due to the fact that heating of the older pavement during the patching operations tends to be limited to just the exposed surfaces of the old pavement. A similar weak bond is likely to exist where a repaved section of road adjoins old pavement.

Still another problem is that hot-mix prepared at a plant for transport to a paving site must be overheated as some cooling during transit may occur. Further, such cooling tends to be uneven throughout the volume of hot-mix and serious temperature differentials may remain even if supplemental heating is provided en route to the paving site or at the site. Consequently, adjacent areas of pavement are put down and worked at significantly different temperatures with adverse effects on pavement quality.

Still another problem with conventional repaving and repair techniques results from the need to maintain hot-mix at high temperatures for long periods during transport and laying operations and in some cases to heat adjacent surfaces to which the asphalt is to be bonded. The practical problems of accomplishing this heating tend to rule out paving operations and all but the most serious repairs during periods of cold or wet weather. In many regions such activities must virtually stop during the winter.

The foregoing discussion has also dealt primarily with roads or other areas formed of asphaltic pavement. There are related serious problems with surfaces paved wholly or in part with other material. Much of the extensive freeway or throughway systems in the United States of America and elsewhere are basically concrete but very commonly these have shoulder strips paved with asphalt and which are subject to the problems discussed above. Moreover, concrete pavement itself deteriorates with use and age and may require an overlay or application of any of various materials accompanied by a heat treatment, which operations are also subject to very serious economic and technical problems of the general kind discussed above.

SUMMARY OF THE INVENTION

This invention provides methods and apparatus for recycling pre-existing asphalt pavement in a highly economical and efficient manner, basically by performing the recycling operations at the site of the existing pavement and in many cases without removing the pavement from the roadbed or other paved surface. Certain aspects of the invention are also applicable to the maintenance of concrete highways or the like and to the recovery of discarded asphalt from dump sites.

In the practice of one form of the invention, successive increments of the old asphalt pavement are rapidly decomposed in place by heating with microwave energy and the constituents are then remixed at the site, in place on the roadbed in some cases. The hot remixed constituents are then graded and recompacted. It is thus possible to progress continuously down a deterioriated highway leaving behind a repaved high-quality surface with characteristics similar to those of a newly constructed highway. Little or no new asphalt and aggregates are needed and very substantial additional cost reductions are realized as the transporting of materials between the work site and a dump and between a mixing plant and the work site is greatly reduced or eliminated. The related need for fleets of trucks, rippers, loader vehicles and the like is correspondingly reduced or eliminated. The need for dump sites for old paving is eliminated and the invention may in fact be adapted to recover asphalt mix from old sites of this kind.

In one form of the invention where fuel-consuming engines are used to drive electrical generators to power the microwave sources at the work site, still further cost and energy economies are accomplished by utilizing the hot exhaust of the engines to supplement or to maintain the heating effects of the microwave energy.

The invention may be utilized to repair and restore asphalt shoulder strips of primarily concrete roads and may also be adapted to salvage road surfaces or the like formed of concrete which has deteriorated. An overlay of asphalt or various sealants may be applied to the concrete and may be heated in place by the apparatus of the present invention and the surface may then be periodically reworked as necessary in accordance with the invention to maintain a high-quality surface for a very extended period of time.

Apparatus in accordance with the invention includes applicator devices for efficiently coupling microwave energy into pre-existing underlying pavement to heat the pavement extremely rapidly and uniformly and further includes structures for preventing the escape of microwave energy from the heating region at the pavement.

One form of the apparatus for recycling asphalt pavement includes a preferably self-propelled vehicle assembly which may be articulated into sections and which carries an applicator for directing microwave energy downward to decompose the underlying pavement and which further carries remixing mechanism extending downward into the decomposed pavement and which may also carry one or more grader blades followed by recompaction devices. Such a vehicle assembly may be traveled down an existing road at a slow rate of speed to repave successive portions of the road as the vehicle progresses.

One or more engine-driven generators carried on the vehicle assembly supply electrical power to operate the microwave source or sources and in a preferred form, the hot exhaust from the engine may variously be utilized to supplement the microwave heating action at the underlying pavement, to continue to heat the pavement constituents during the subsequent remixing operations, to maintain a supply of supplemental constituents carried on the vehicle at an elevated temperature, to heat compactor surfaces to avoid adhesion of asphalt thereto, or to accomplish any combination of these results.

Accordingly it is an object of this invention to provide more efficient and economical methods and equipment for recycling asphalt pavement.

It is an object of the invention to reduce materials and hauling costs in connection with the repaving of roadbeds and other surfaces with asphaltic compositions.

It is another object of the invention to provide methods and apparatus for repaving or repairing asphalt roads and the like with less consumption of costly materials and energy and to reduce pollution and other adverse ecological effects in connection with such operations.

It is another object of the invention to provide methods and apparatus for improving the quality of bonding of newly mixed or remixed asphalt with adjacent areas of old pavement in the repair and reconditioning of roadbeds or other paved surfaces.

It is still another object of the invention to provide for efficient utilization of microwave energy in the repaving or repairing of roadways and other paved surfaces while avoiding the broadcasting of microwave frequencies from the work site.

It is another object of the invention to provide methods and apparatus for restoring and maintaining concrete highways and the like.

The invention, together with further objects and advantages thereof, will best be understood by reference to the following description of preferred embodiments taken in conjunction with the accompanying drawings.

BRIEF DESCRIPTION OF THE DRAWINGS

In the accompanying drawings:

FIG. 1 is a graphical depicton of temperatures reached by samples of certain materials as a function of time upon similar exposures to microwave energy, FIG. 2 is a graphical depiction of temperatures reached by a diverse variety of road-paving materials upon being heated in a 500-watt microwave oven, operating at 2450 megahertz, for periods of two minutes, FIG. 9 is a broken-out frontal view of a second form of microwave applicator vehicle for heating and decomposing old asphalt pavement, FIG. 10 is a view of the underside of a corner portion of the vehicle of FIG. 9 taken along line 10—10 thereof, FIG. 11 is a view taken along line 11—11 of FIG. 10 illustrating details of a microwave energy barrier.

DESCRIPTION OF THE PREFERRED EMBODIMENTS

Figure 3:
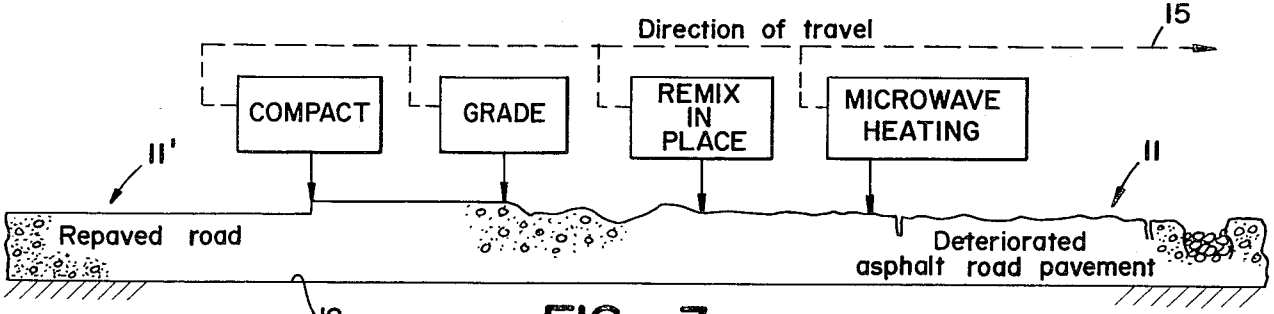
FIG. 3 is a block diagram illustrating successive steps utilized in the recycling of deteriorated asphaltic pavement in accordance with the method of this invention.

In accordance with the present invention, deteriorated asphalt pavement is decomposed by being heated in place at its original location and is then remixed and relaid also at the original location. Compared with repaving in the conventional manner by mechanically breaking up old pavement, trucking it to a dump site and then trucking in and relaying new paving mix, very pronounced cost reductions and savings in energy consumption, labor, land and equipment needs are effected for the reasons previously discussed.

To fully realize these objectives, on-site pavement recycling in accordance with the invention requires that the heating and decomposing of the old pavement in place be accomplished at least in part with a heating medium which has not heretofore been used for such purposes, specifically by directing microwave energy into the existing pavement at the roadbed or the like. Other heating techniques are comparatively very slow and uneven in effect as heat, produced outside the pavement by burning a fuel for example, can be applied only to the surface of the pavement and must then be transferred inward to the interior of the old pavement by conduction. Heat transfer by conduction is a relatively slow process and inherently gives rise to pronounced temperature gradients within a solid substance such as old pavement. In contrast, microwave energy penetrates virtually instantaneously into old pavement and very rapidly generates heat not just at the surface but throughout the interior volume of the pavement.

For the present purposes, microwave energy may be defined as radiant electromagnetic energy having a frequency within the range from about 400 megahertz (MHZ) to about 300,000 MHZ. As a practical matter, governmental authorities in any given region usually allocate certain specific frequencies within the total microwave band for various types of usage, such as communications links, radar systems, industrial processing and others. Thus the references herein made to the specific frequencies of 915 MHZ and 2450 MHZ, which are the two frequencies currently assigned to industrial microwave equipment in the United States of America, should not be construed as necessarily meaning that these are the best or only suitable frequencies from the strictly technical standpoint nor should they be considered as limitative of the scope of the invention.

Microwave sources, such as magnetron tubes or the like, suitable for producing microwave frequencies at high power outputs are known to the art and have been widely used for such purposes as communications systems, radar systems and for heating of substances ranging from food products to the curing of plastics.

At first consideration, microwave energy might appear to be ill-suited to the heating of asphalt pavement. Aside from the difficulties of efficiently coupling such energy into an exposed roadway or the like while preventing broadcasting of such energy outward from the work site, testing has shown that microwave energy couples to pure asphalt so weakly that it might be considered to be almost transparent to radiant microwave energy.

Different substances differ strongly in their capacity to absorb microwave energy and to thereby convert such energy into internal heat. The extent to which microwave energy is absorbed or coupled into a substance is dependent on certain atomic or molecular properties of the substance in relation to the microwave frequency or wavelength and as noted above the efficiency of the absorption process in pure asphalt is extremely poor. By way of contrast, the absorption of microwave energy by water molecules is a relatively efficient process and in many prior usages where substances have been heated with microwave energy, such as in cooking food products for example, it is assumed for practical purposes that heating occurs primarily by interaction with the water content of the substance. FIG. 1 is a graph illustrating the temperatures reached by a sample of pure asphalt and also by a sample of water during similar exposures to microwave energy for a period of several minutes. The relative inefficiency of heating of the asphalt as compared to the heating of water is readily evident.

FIG. 1 also illustrates the temperatures reached by microwave heating a sample of old asphalt pavement under essentially the same conditions. Surprisingly, there is not only a highly efficient production of heat in such pavement but it is in fact markedly more efficient than the heating of water by microwave. As pure asphalt is very unresponsive to microwave energy, it may be inferred that microwave is coupling strongly to the other constituents of the pavement which are rock and sand particles of various sizes collectively known as aggregates. This is in itself of considerable interest since the elements silicon and oxygen constitute almost three-fourths of the composition of rocks in the earth's crust and a well-known constituent formed of these elements is the mineral quartz. Quartz couples so poorly to microwave energy that it is often used to form energy transparent windows in microwave systems. Nevertheless, experiments have shown that microwave energy couples extremely strongly to rock particles of any of a variety of types that are commonly used in pavement. For comparison purposes, FIG. 1 also illustrates the heating effect on a typical sample of ½ inch (1.3 cm.) diameter rock gravel of a microwave exposure similar to that used to obtain the data for pure asphalt and for water.

FIG. 2 illustrates the heating effect of a microwave energy exposure on a diverse group of different road repair rock samples obtained from various different locations in the geologically diversified state of California and in Nevada and further illustrates the comparative degree of heating of pure asphalt, quartz and water under the same conditions. It may be seen that the efficiency of microwave heating is exceedingly high for all these varying types of aggregate and for a typical sample of old asphalt paving and for a sample of concrete as well.

The reason for the demonstrated high efficiency of microwave heating of a variety of rock types is believed to be that the elements silicon and oxygen, in addition to combining to form quartz ($SiO_2$) also combine with other elements to form the group of minerals known collectively as silicates which constitute over ninety percent of the earth's crust. It may be inferred from the data of FIG. 2 that microwave couples strongly to silicates as opposed to quartz. The fundamental molecular structure of all silicates includes a tetrahedron made up of a silicon atom at the center and oxygen atoms at each of the four corners. The silicate crystal structures are apparently polar dielectrics with fairly high values of dielectric permittivity (k). A high value of dielectric permittivity indicates that a large displacement of polarizing charges occurs in a crystal structure in the presence of the voltage stresses imposed by microwave fields and this is the process by which microwave energy is transformed into heat in a dielectric substance.

If a sample of old pavement formed only of asphalt and extremely pure quartz aggregates could be located and tested, it is possible that less efficient heating would be observed but the data of FIG. 2 indicates that such pavement, if it exists at all, must be uncommon.

The fact that microwave energy heats rocks faster than it heats water as depicted in FIG. 1 does not mean that rock materials absorb more energy than water in a microwave field. This seeming contradiction may be explained by the fact that the specific heat of water, which by definition is (1.0), is much higher than that of rocks. Most rocks have a specific heat of around (0.2) and this means that a given microwave input will heat about five times more rock aggregate than water to a given temperature.

Considering now the steps involved in the practice of the invention as applied to the repaving of a deteriorated asphalt road, with reference to FIG. 3, the existing pavement 11 is heated by directing microwave energy into the pavement at the roadbed 12 to the extent necessary to heat the composition to the point where the asphalt becomes liquid or semiliquid. As discussed above, such heating probably occurs initially within the aggregate component of the paving, but heat is rapidly transferred to the asphalt. Heating to temperatures at or above about 170° F. (77° C.) is in most cases sufficient for this purpose although there is some variation depending on the exact composition of the old pavement. When heated to the point where the asphalt binder becomes at least semiliquid, the old pavement loses cohesion and may readily be crumbled.

After the decomposition of the old pavement by heating, the original constituents are then remixed to redistribute the asphalt and to reduce the constituents to a loose mass which can be reworked. At this stage some supplementary new asphalt, aggregates or paving oils may be added in if desired although this is by no means always necessary. In many cases, it is found that the lower portions of old pavement contain relatively more asphalt than the upper portions and remixing redistributes the asphalt to produce a desirable composition throughout.

As will hereinafter be described in more detail, this remixing can be accomplished by stirring, tilling, raking or other operations right at the roadbed so that the pavement constituents remain substantially at their original location on the roadbed. Alternately, the decomposed pavement may be briefly lifted from the actual roadbed 12 by a conveyor or the like, as will hereinafter be described in more detail, for remixing and may then be returned to the roadbed but in either case the remixing operations are preferably conducted at the work site and without transporting material any substantial distance in trucks or the like.

Subsequent to the remixing operations and while the pavement constituents remain decomposed and at an elevated temperature, the material is then graded. Subsequent to the grading operation the mix is recompacted on the roadbed. The result, upon cooling and hardening of the pavement constituents, is a high-quality smooth repaved roadway 11'.

While the above-described process may be accomplished by performing the several steps in sequence at a given selected small area of the deteriorated road 11, there are advantages in many cases to performing each of the steps concurrently while slowly progressing continuously down the deteriorated road 11 as indicated by arrow 15. If the microwave heating step is performed while traveling in this manner, successive increments of the deteriorated pavement are decomposed while successive increments of the previously decomposed pavement are being remixed. The grading and compacting operations may then be progressed down the roadway in an essentially similar manner. Examples of apparatus for accomplishing the several operations on a simultaneous and continuous basis will hereinafter be described.

Figure 4:
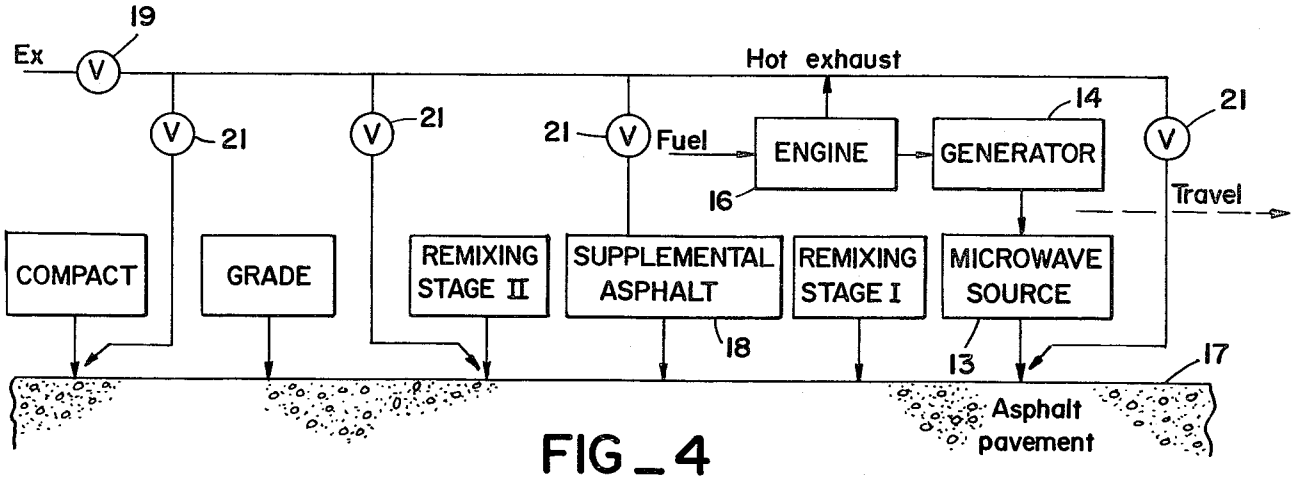
FIG. 4 is a block diagram illustrating additional steps which may be employed in the practice of the invention.

It has been pointed out that one of the advantages of the process is a marked reduction in energy consumption relative to conventional repaving techniques. One major way by which the process of FIG. 3 accomplishes such a reduction is by greatly reducing or eliminating fuel requirements for transporting materials back and forth between the work site and a dump and between the work site and remote aggregate sources and asphalt plants. FIG. 4 schematically illustrates a further refinement of the process in which still greater fuel usage efficiency and certain other advantageous results are realized.

Referring now to FIG. 4, there is usually no preexisting source of electrical power available at the work site to operate the microwave source or sources 13. Consequently one or more electrical generators 14 are provided and these are in turn driven by one or more fuel-consuming engines 16. Engines 16 may variously be piston engines of the form which operate on diesel fuel, liquefied natural gas or gasoline for example or may be turbine engines which also operate from similar fuels but in any case it is characteristic of such engines that much of the energy content of the consumed fuel is normally wasted in the form of heat discharged in the exhaust of the engine. In the process as depicted in FIG. 4 much of this discharge heat is recovered and utilized for productive purposes.

In particular, at least a portion of the hot exhaust from engines 16 may be directed to the underlying asphalt pavement 17 to supplement the heating effect of the microwave energy thereon. The hot exhaust may be directed at the pavement for this purpose in the same region where the microwave is being applied and it may also be directed at the decomposed pavement constituents during the remixing stage to maintain a desirably high temperature during remixing. Portions of the exhaust heat may also be used to maintain the surfaces of compaction devices at an elevated temperature to inhibit the adhesion of pavement constituents to such surfaces during compaction operations. As illustrated in FIG. 4, the hot exhaust may be utilized for any one of these purposes or for any combination of such purposes. As fuel-consuming engines ordinarily discharge and waste, in the form of heat, as much as 80% of the energy content of the fuel, the savings of fuel resources and consequent repaving cost reductions which may be realized by utilizing discharge heat from the engines are substantial.

In the specific form of the process illustrated in FIG. 4, a first remixing step is followed by the application of supplemental asphalt to the pavement constituents and then additional remixing is performed. Where such supplemental paving constituents are present, another portion of the hot exhaust from the engine 16 may be used to maintain the supply of supplemental asphalt or the like in a heated condition as illustrated in FIG. 4.

To facilitate any or all of the exhaust heat utilization steps described above, a valve 19 may be present in the exhaust line of engine 16 and a series of subsidiary valves 21 may also connect to the exhaust line to enable selective control of the direction of hot exhaust to any of the work zones described above.

Figures 5, 6, 18:
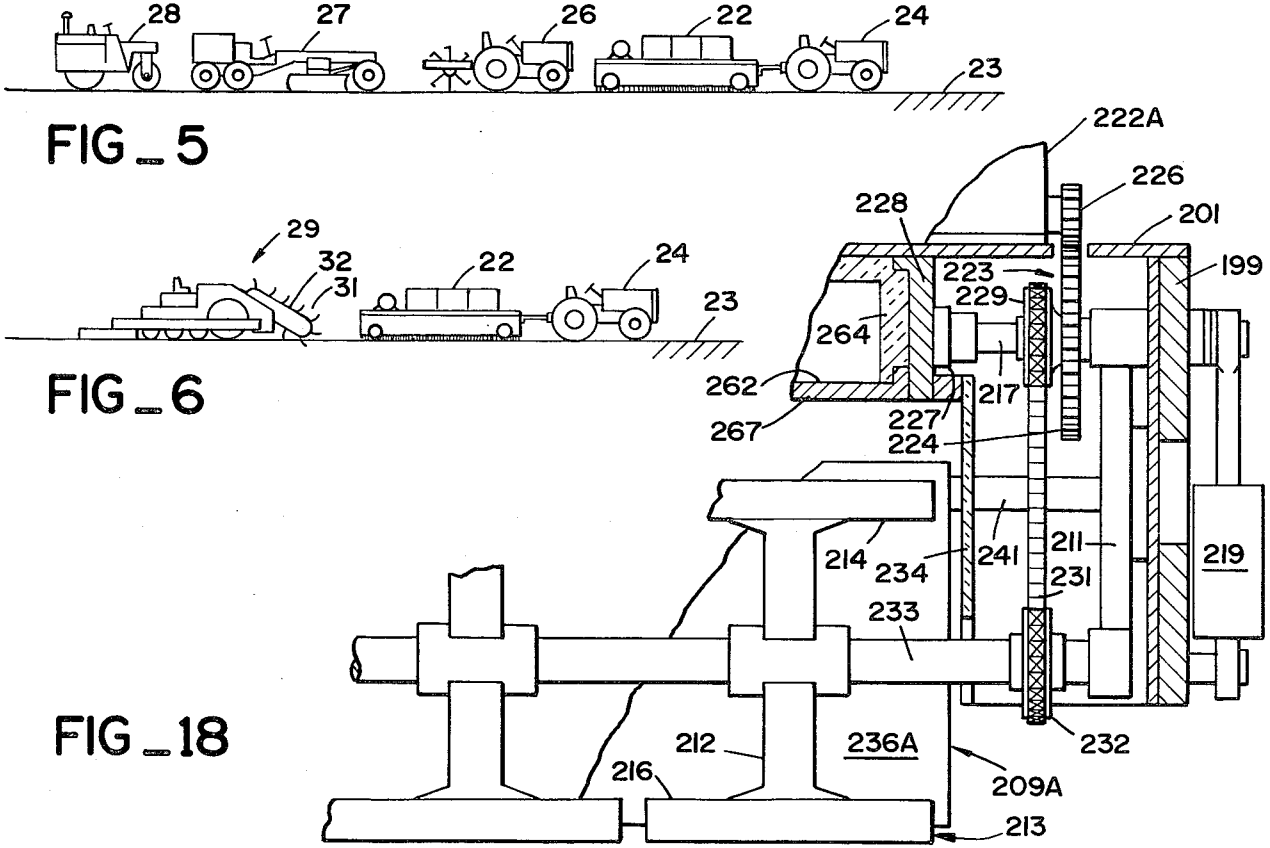
FIG. 5 illustrates the practice of the method of this invention utilizing largely known forms of equipment.
FIG. 6 depicts the practice of this invention utilizing a paver apparatus of known construction.
FIG. 18 is a cross-section view of a portion of the vehicle of FIG. 17 taken along line 18—18 thereof.

In many situations it is preferable to use integrated equipment systems specifically designed to perform the above-described method and examples of such systems will be described. However, for small projects or where an integrated equipment system is not available, it is also possible to realize much of the advantages of the process by using known forms of construction equipment for performing certain of the steps. In particular, the remixing, grading and compacting operations may, if desired, be performed with existing equipment available to the construction industry. Suitable apparatus for heating and decomposing pavement with microwave energy while traveling down a roadbed or the like is an exception as no device suited for this purpose has been heretofore known to the art.

Where existing construction equipment is to be used to the extent possible, as illustrated in FIG. 5, a microwave applicator 22 may be traveled slowly down a deteriorated asphalt road 23 either by self-propulsion means on the microwave applicator vehicle or, as in this example, by being towed by some other available powered vehicle such as a tractor 24. Suitable detailed constructions for the microwave applicator 22 will hereinafter be described. The remixing operation may then be performed by means such as one or more powered rotary tillers 26 which follow along behind the microwave applicator although certain forms of plows, rakes and the like may also be adapted for this purpose. Regrading may then be accomplished by a motor grader 27 following the tiller. Finally, recompaction may be accomplished by a roller 28 or other known compaction devices traveling along behind the grader.

The utilization of a series of self-propelled existing types of construction vehicle as depicted in FIG. 5, is not necessarily the most efficient technique for practice of the invention although it has pronounced advantages over conventional repaving operations for the reasons hereinbefore discussed. Where the repaving operations are to be continued over a long period of time to recondition a large amount of pavement, it may be preferable to utilize one of the known forms of self-propelled integrated pavers to perform the remixing, grading and compaction steps. A paver 29 of this kind as depicted in FIG. 6 may contain and carry the necessary mechanism for mixing, laying, grading and compacting asphalt pavement, suitable detailed constructions for such apparatus being known to the art. In one known form these large pavers 29 include scoops 31 on an endless conveyor or elevator 32 at the front of the vehicle which carries material up into the paver. The elevator 32 has heretofore been used for picking up fresh asphalt mix which has been deposited from trucks in a windrow on the roadbed along which the paver travels but may be used to lift old pavement which has been decomposed by the techniques of the present invention.

In the practice of the present invention as illustrated in FIG. 6, the microwave applicator vehicle 22 may again be traveled continuously along a deteriorated road 23 to heat and decompose the old pavement and may be followed by the paver 29 with the conveyor 32 of the paver being utilized to pick up the hot decomposed old pavement behind the microwave applicator for remixing, relaying, regrading and recompaction.

In many cases, the method may be most efficiently practiced by making use of highly specialized new forms of integrated road-paving recycling systems and examples of such apparatus will hereinafter be described in detail. Regardless of whether older types of equipment or new road-paving recycling system is used, it is necessary to have apparatus suitable for directing large amounts of microwave power into underlying pavement, preferably while traveling along the pavement, and this presents several serious technological problems.

Figure 7:
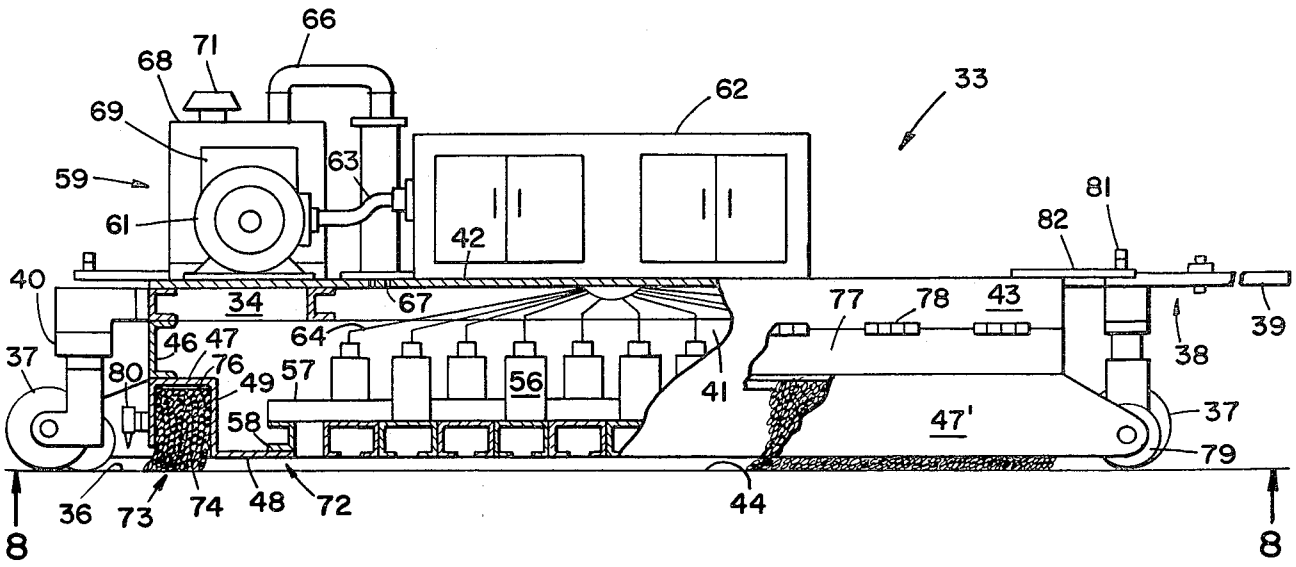
FIG. 7 is a broken-out side elevation view of a first form of microwave applicator vehicle for heating and decomposing asphalt pavement in place.
Figure 8:
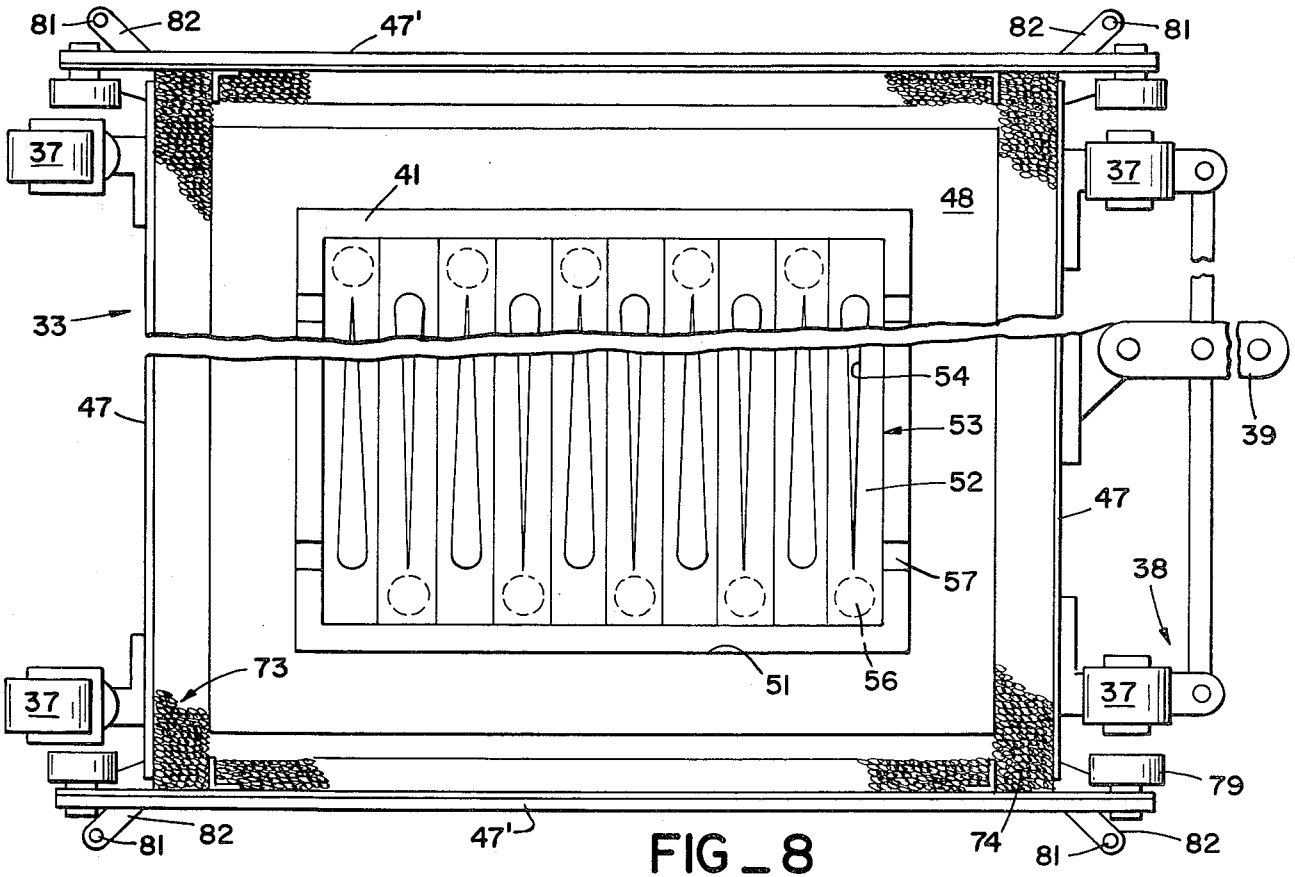
FIG. 8 is a view of the underside of the vehicle of FIG. 7 taken along line 8—8 thereof.

Prior microwave heating devices or microwave ovens were designed to heat substances which can be physically moved into an internal region which is either fully surrounded by electrically conductive material in operation or which is transversed by a conveyor traveling through microwave trapping devices at each end of the internal heating chamber. This assures efficient use of microwave energy and avoids the broadcasting or release of any significant amount of microwave energy out into the surrounding environment. Escaping microwave energy can constitute a safety hazard and can interfere with various forms of distant electronic equipment by creating interference effects. An efficient transfer of energy from the microwave generator or source into the substance to be heated is much more easily arranged for in these conventional forms of microwave heating systems. The substance to be heated may either be situated at a specific optimum geometrical location relative to the microwave-transmitting means such that close coupling in the electrical sense occurs or, as in the case of home microwave ovens for example, the substance to be heated may be essentially surrounded by electrical conductive material so that microwave energy which initially passes through the substance without being transformed into heat or which is initially directed away from the substance will be repeatedly reflected back and forth by the conductive chamber walls and will make many passages through the substance until is is eventually absorbed and converted to heat. These known forms of microwave heating device having internal heating chambers are unsuited for heating old road pavement in place on a roadbed. For that purpose, a specialized applicator must be provided which efficiently couples microwave energy into an underlying surface, preferably while traveling therealong and while preventing escape of any significant amount of microwave power. A first example of a suitable microwave applicator 33 of this kind is depicted in FIGS. 7 and 8 of which FIG. 8 constitutes a view of the underside of the applicator structure shown in side elevation in FIG. 7.

Applicator 33 may have a high-strength rectangular frame 34 formed of steel channel members or the like and which is supported above the old pavement 36 by road wheels 37 at each corner. The road wheels 37 may be pivotable about vertical axes with the front road wheels being coupled to a swingable towing hitch 39, situated at the center of the front end of the vehicle, through conventional wagon steer linkage 38 in order to enable the applicator to accurately track the vehicle which tows the applicator. If the applicator 33 is designed to be a self-propelled vehicle, powered and steerable road wheels may be provided.

Microwave energy will not pass through an electrically conductive wall. Except under specialized circumstances, it will not propagate through an opening in such a wall which is substantially smaller in all transverse dimensions than the wavelength of the microwave energy. While some microwave energy may be transmitted through an opening in a conductive wall if the opening has a maximum transverse dimension approaching the wavelength of the microwave energy, the extent to which this occurs decreases as the length of the opening in the direction of microwave propagation increases. There exists a configuration for openings of this kind which constitutes what is known as a cut-off waveguide and which effectively blocks release of microwave energy. In general, a cut-off opening must be longer in the direction of energy propagation as the largest transverse dimension of the opening becomes closer to the wavelength of the microwave energy.

Still another means of blocking the propagation of microwave energy involves disposing a volume of electrically nonconductive material of certain so-called lossy types in the path of the microwave energy. Such materials do not reflect microwave back towards the region from which it arrived, as in the case of electrical conductor containment structures, but act instead to absorb the microwave energy by converting it to heat. Not all nonconductive materials are suitable for this purpose as microwave energy couples strongly to certain nonconductors and very weakly to others. As previously discussed, nonconductive materials which are efficient microwave absorbers are in general those which have a relatively high dielectric permittivity factor (k). Water is one such substance. It is of particular interest to the present invention that asphalt pavement is a highly lossy material although pure asphalt is a very poor absorber as previously discussed.

These various means of preventing the spread of microwave energy from a predetermined region have been briefly reviewed above inasmuch as the applicator 33 of FIGS. 7 and 8, as well as certain other applicators to be hereinafter described, makes use of each of these techniques for defining a microwave containment region 41 within the applicator vehicle 33 and which extends for several inches downward through the underlying pavement 36.

To block upward propagation of microwave energy from region 41, rectangular platform panel 42 having at least a lower surface formed of electrically conductive material is secured to frame 34. A side panel 43, also formed at least in part of electrically conductive material, extends downwardly along each side of frame 34 and platform panel 42 to block the propagation of microwave energy from region 41 in lateral directions. As the deteriorated pavement 36 over which the vehicle travels may exhibit some surface irregularities, side panels 43 cannot usually extend all the way to the underlying pavement 36 but instead a small gap 44, sufficient to accommodate to such irregularities, must be provided between the side panels and the pavement. This gap is preferably kept as small as is consistent with enabling travel of the vehicle over the pavement and may typically be as small as $\frac{1}{4}$ inch (0.6 cm.) in some instances as road surfaces, even in deteriorated condition, are often highly flat. If necessary to accommodate to pavements of different roughness, the pivot supports 40 of road wheels 37 may be of the vertically adjustable form in order to raise and lower the frame and side panels of the vehicle as necessary.

The presence of even a small gap 44 between the side panels 43 and pavement 36 would, in the absence of further structures, tend to allow the sideward release of microwave energy from region 41. Microwave trap structures suitable for blocking such release of energy will be hereinafter described.

Outward propagation of microwave energy from region 41 in the forward and backward directions, with respect to the direction of travel of the vehicle, is blocked in part by transverse channel members 46 secured to the underside of the front and back ends of frame 34, the channel members being formed of electrically conductive material. Secured below transverse members 46 are transverse electrically conductive trap housing members 47, of inverted U-shaped cross section, which extend still further downward towards the underlying pavement 36. Thus frame 34, together with channel members 46 and trap housings 47 collectively form electrically conductive front and back walls of microwave region 41 for blocking release of microwave energy in the forward and backward directions except at the small gap 44 between the lower end of housings 47 and the underlying pavement 36.

A flat rectangular open-centered base panel 48 formed of electrically conductive material is secured at the underside of the vehicle, the outermost side edges of the base panel being secured to the lower edges of side panels 43 and the forward and rearward edges of the base panel being secured to the lower edge of the innermost portions 49 of trap housings 47. The rectangular central opening 51 of base panel 48 defines a microwave application area at the underlying pavement 36 while the region directly beneath the base panel 48 constitutes a microwave energy-trapping region as will hereinafter be discussed in more detail.

To couple microwave energy into pavement 36, a plurality of waveguides 52, of the type known as leaky waveguides, are disposed within region 41. The waveguides 52 are oriented transversely with respect to the path of travel of the vehicle in this example of the invention and are disposed against each other in parallel relationship to form a waveguide assembly 53 which has a width and length slightly less than the width and length of the opening 51 of base panel 48 so that the ends and sides of the waveguide assembly in conjunction with opening 51 of the base panel define a rectangular gap. Waveguides 52 in this example are of the rectangular cross-section form and a microwave energy emitting slot 54 extends lengthwise along the underside of each waveguide. Slots 54 are of progressively diminishing width from one end of the associated waveguide 52 towards the other in order to equalize the emission of energy at successive portions of the waveguide thereby accommodating to the fact that energy is coupled into one end of the waveguide. The slot is of minimum width at the end closest to the energy source. As is known to those skilled in the art, other slot configurations may also be used to achieve a similar result in a leaky waveguide.

Adjacent ones of the waveguides 52 of assembly 53 are reversed end to end so that the ends of slots 54 of greatest width of alternate ones of the waveguides are closest to one side of the vehicle while the corresponding ends of the intervening waveguides are closest to the other side of the vehicle. Each waveguide 52 is excited by a magnetron tube 56 or other suitable microwave generating source of any of the several forms known to the art. The magnetron tube 56 at each waveguide is disposed above the end of the waveguide at which slot 54 is of minimum width. Thus, in this example, the magnetron tubes 56 are arranged in two parallel rows each row extending along an opposite side portion of the waveguide assembly 53. The magnetron tubes 56 may be supported directly on the top surfaces of the associated waveguides 52 if desired and the waveguide assembly 53 may be fastened to support members 57 which extend in the direction of travel of the vehicle and which have ends secured to transverse channel members 58 which are in turn fastened to the upper surface of base panel 48.

The above-described supporting structure for the waveguide assembly 53 is preferably proportioned to situate the lower surfaces of the waveguides as close as practical to the underlying pavement 36 taking into account the possibility of small irregularities in such pavement. Thus, the lower surfaces of the waveguides may be spaced above the roadbed a distance corresponding to that of the gap 44 as previously described.

Electrical power for operating the magnetron tubes 56 may be transmitted to the applicator 33 through a cable connecting with another vehicle which tows the applicator, examples of such systems being hereinafter described. In the example of FIGS. 7 and 8, the applicator 33 carries its own power source such as an engine 59 driving an electrical generator 61 both of which may be disposed on the vehicle on top of frame 34 and platform panel 42. A power supply 62 of one of the suitable forms known to the art is carried on platform panel 42 and is electrically coupled to generator 61 through a cable 63 and to each magnetron tube 56 through a series of conductors 64 which transmit operating voltages to the magnetron tubes 56.

Engine 59 may variously be a piston engine or a turbine engine operating on a suitable fuel such as diesel oil, gasoline or liquefied natural gas. Engines of any of these types ordinarily waste a large portion of the energy content of consumed fuel as sizable quantities of heat are discharged to the surrounding environment largely through the discharge of hot exhaust gases. Fuel may be conserved and operating costs may be significantly reduced in the present instance by utilizing this heat energy for productive purposes. In the applicator vehicle 33, ducting 66 is provided to channel the hot exhaust gas of engine 59 through a series of small openings 67 in top panel 42 leading into the microwave region 41. To avoid release of microwave energy, openings 67 may each have dimensions substantially smaller than the microwave wavelength or the ducting 66 may be formed of electrical conductor and may have a cross-sectional area below cut-off dimensions. The exhaust gases within region 41 then flow downward through the opening 51 between the edges of waveguide assembly 53 and base panel 48 into the gap 44 immediately above the pavement 36 where much of the heat content of the exhaust gas transfers to the pavement itself to supplement the microwave heating. Still further utilization of the heat generated by engine 59 may be accomplished if the engine is enclosed by a gas-tight housing 68 except at the cooling radiator 69 through which cooling air is drawn by the engine fan and except for the air intake 71 of the engine. Thus air which has been drawn into the housing 68 through radiator 69 and which has been heated in the process of cooling the radiator is intermixed with the hot exhaust gases and delivered to the surface of the pavement 36. The engine exhaust heat may be utilized for other purposes, if desired, as will hereinafter be described.

Considering now suitable trapping structures for preventing the escape of microwave energy at the gap 44 between the pavement 36 and the underside of the above-described vehicle components, any of a variety of different forms of trap may be employed for such purposes of which two are used in combination in the example depicted in FIGS. 7 and 8. A first such trapping device, which may be characterized as a gap trap 72, is defined simply by the electrically conductive undersurface of base panel 48 and the subjacent portions of pavement 36. Owing to the above-described configuration of base panel 48, the gap trap 72 extends along both sides and across the front and back of the area at which microwave energy is applied to the pavement.

The gap trap 72 functions to suppress outward horizontal propagation of microwave energy at gap 44 owing to the fact that the electrically conductive material of panel 48, which defines the upper boundary of gap 44 in the trapping region, acts to reflect microwave energy whereas the pavement 36 which defines the bottom boundary of gap 44 in the trapping region acts to absorb microwave energy. Microwave energy, such as the energy entering gap trap 72 from the region 41, does not propagate in space by flowing in a simple coherent manner. Instead such energy tends in effect to continually disperse in all directions at right angles to the nominal path of energy flow. The sizable portion of such energy which is directed downwardly in passage along gap trap 72, because of this effect, enters the lossy pavement 36 and is absorbed and converted to heat. That portion of microwave energy which tends to move in an upward direction is reflected downward by the conducting undersurface of panel 48 and as a consequence also enters the pavement where it is absorbed. Thus microwave field intensity decreases sharply in the outward direction within the gap trap 72. The degree to which microwave energy is attenuated in passing along the gap trap 72 is in part a function of the length of the trap in the direction of microwave propagation. In theory, the trap 72 could be made sufficiently long to diminish the microwave field to any desired extent so that whatever amount of microwave power is actually released from the outside edge of the trap is within tolerable limits. In practice this would, at least in many cases, require an applicator vehicle of undesirable length and breadth. Accordingly, the gap trap 72 of applicator 33 is supplemented by use of another form of microwave blocking means which may be termed a chain trap 73. The use of two different forms of trap is advantageous even where one trap may suffice in theory since unusual conditions that temporarily detract from the effectiveness of one form of trap will not necessarily affect the other. For example, the inadvertent presence of a sizable flat sheet of discarded conductive metal foil lying on the pavement 36 under the gap trap 72 might cause the temporary release of increased amounts of microwave energy through the gap trap 72 in the immediate region of the foil. Such an occurrence would, if anything, enhance the trapping action of the chain trap 73.

The chain trap 73 may consist of a mass of short lengths of chain 74 formed of links of electrically conductive metal such as steel, the lengths of chain having upper ends secured to the upper inner surface of housing 47 by a suitable hanger element 76. Chains 74 extend downward within housing 47 and are of sufficient length that the lower ends of the chains drag along the surface of pavement 36, the chains preferably being of somewhat greater length than the spacing between hanger 76 and the pavement so that the chains may drop into and occlude any cracks, declivities or other small surface irregularities which may be encountered in the pavement. The chains 74 are closely packed together and form a thick mass of conductive metal which is sufficiently flexible to accommodate to variations in gap 44 but in which such through passages or interstices as exist are convoluted and have maximum dimensions well below cut-off dimensions for the microwave frequency which is utilized. The chain trap 73 extends along both sides of the gap trap 72 and transversely across the front and back of the gap trap as well.

In some instances the microwave applicator 33 vehicle may have an effective width which does not completely span the roadway or other paved area which is being worked and under these circumstances the repaving operations are performed by successively traveling along parallel strip portions of the roadway or the like. In other instances the applicator vehicle may have sufficient width to completely span a roadway and therefore to accomplish the repaving operation in one passage. Under either circumstance conditions exit at least part of the time in which one or both sides of the vehicle are situated at one side of the pavement 36 and over the road shoulder or other unpaved adjacent surface. Such road shoulders or the like may not be precisely at the same level as the pavement 36, road shoulders being more often slightly depressed relative to the adjacent pavement surface. As pointed out above, the chain traps 73 have some ability to adjust to variations in distance of the subjacent surface from the undersurfaces of the vehicle. To further accommodate to elevational differences along the edges of the old pavement, it may be desirable that the portions of the chain trap 73 which extend along the sides of the vehicle be capable of some vertical movement as a whole in order to accommodate better to sizable differences in the elevation of the pavement 36 and adjacent unpaved areas.

For this purpose the chain trap housings 47' which are situated along the sides of the applicator 33 have inclined upper portions 77 which extend outward and downward from the side panel 43 of the vehicle and which are coupled to the side panels through hinges 78. Support wheels 79 are journaled on the side housings 47' to ride along the underlying surface thereby causing the housings 47' to swing outward and upward or inward and downward as necessary to accommodate to differences of the elevation of road shoulders and the like relative to the pavement 36. Hinges 78 are preferably of the disassemblable form so that the side trap housings 47' and the associated portion of chain trap 73 may be removed from the vehicle to facilitate transportation between work sites.

In operation, the applicator 33 is slowly towed along the pavement 36 which is to be recycled. Microwave energy generated by magnetron tubes 56 is coupled into the underlying pavement 36 by waveguides 52 causing heating and consequent softening of the asphalt and decomposition of the pavement constituents which may then be remixed, regraded and recompacted while in the heated state. The pavement heating action of the microwave energy is supplemented in this particular microwave applicator 33 by heat transfer from the hot exhaust gases of engine 59.

The degree of heating of the pavement 36 which is realized is a function of several variables including the aggregate microwave power output of the magnetron tubes 56, the composition and starting temperature of the pavement 36, the amount of heat transferred to the pavement by the engine and exhaust gases and the rate of travel of the applicator. Under most circumstances, heating of the pavement 36 to temperatures within the range from about 170° F. (77° C.) to about 250° F. (121° C.) produces the desired decomposition and enables the subsequent remixing, regrading and recompacting. While the degree of heating of the pavement can be controlled by regulating the power output of the magnetron tubes 56 and to some extent by controlling the proportion of the engine exhaust which is directed to the pavement surface, in most cases it is desirable to operate at maximum levels in both respects and to control the temperature to which the pavement 36 is heated by regulating the speed of the applicator vehicle along the roadway or the like. To facilitate this form of control a pavement temperature sensor 80 of a suitable known form, such as an infrared radiation detector for example, may be carried on the rear of the vehicle slightly above the pavement 36. The applicator vehicle may be speeded up if the temperature sensor indicates that the pavement is being heated to a greater extent than is desired and the vehicle may be slowed under reverse circumstances.

It is also desirable in most instances to provide microwave energy detectors 81 of suitable known form at several locations around the exterior of the vehicle to indicate if microwave leakage should occur. If desired, such detectors may be interlocked with the microwave power supply system 62 to shut down magnetron tubes 56 upon detection of a microwave level above a predetermined minimum tolerable value. By mounting four such microwave detectors 81 on arms 82 each of which extends obliquely from a separate corner of the applicator vehicle, each such detector may efficiently monitor for possible leakage at two sides of the vehicle.

Modifications of various aspects of the applicator vehicles are readily possible. The waveguides, for example, may be aligned in the direction of travel instead of being transverse. Other forms of trapping device for suppressing the release of microwave energy may also be employed. FIGS. 9, 10 and 11 in conjunction depict a modified applicator 83 embodying each of these modifications.

The microwave applicator 83 of FIGS. 9, 10 and 11 may again have a horizontal rectangular frame 84 of high-strength structural members supported above the pavement 86 by road wheels 87 and provided with towing linkage 88. A horizontal rectangular platform panel 89 is again carried on the frame 84 and a microwave power supply and control system cabinet 91 is situated above the panel. Where the applicator 83 vehicle carries its own electrical power source as in this example an engine 92 may be provided to drive an electrical generator 93 with the engine and generator being disposed above panel 89. Ducting 94 may again be provided to direct the hot exhaust of engine 92 downward into the region below panel 89 in order to supplement the effect of microwave energy in heating the underlying pavement 86.

A plurality of magnetron tubes 96 or the like generate microwave energy and each is coupled to one end of an associated one of a series of waveguides 97. The waveguides 97 differ in several respects from the corresponding components of the previously described microwave applicator vehicle. Waveguides 97 in this instance are situated at a higher level above the pavement 86. Waveguides 97 are disposed in a parallel but spaced-apart relationship to each other and are aligned with the direction of travel of the applicator vehicle instead of having a transverse disposition as in the previous case.

As is known in the art, a variety of different slot configurations may be used in waveguides to provide for radiation of microwave energy from successive portions of a surface extending along the waveguide. In this example, the underside of each waveguide 97 is provided with a series of spaced-apart short transverse non-resonant parallel slots 98 for this purpose. The waveguides 97 are thus slotted lossy waveguides of the general form described in prior U.S. Pat. No. 3,263,052. Power radiating waveguides having resonant slot configurations may also be used.

Electrically conductive side panels 99 extend downward from frame 84 at each side of the vehicle with the lower ends being spaced above the pavement 86 to leave a small gap 101 which is preferably just sufficient to accommodate to irregularities in the pavement surface over which the vehicle may be required to travel. A horizontal rectangular subplatform member 102 extends between side panels 99 at an intermediate level between platform 89 and the pavement 86. The lower portion of each waveguide 97 fits into a separate one of a series of rectangular slots 103 in subplatform 102 so that the lower portions of the waveguides in effect constitute a continuation of the electrically conductive surface defined by the subplatform. Because of this arrangement, the upper boundary of the free microwave energy region 104 is not formed by the platform panel 89 as in the previous example but is defined instead by the subplatform 102 and contiguous undersurfaces of the waveguides 97. To enable hot exhaust gases from engine 92 to flow downward to the pavement 86, subplatform 102 is transpierced by a large number of apertures 106, arranged in parallel rows along each side of each waveguides 97 in this example, which have diameters substantially smaller than the wavelength of the microwave energy generated by magnetrons 96 so that microwave energy is confined to the region below the subplatform 102.

To inhibit sideward propagation of the microwave energy emitted by waveguides 97 and to provide for more individualized control of microwave field intensity at the region of the pavement beneath each waveguide if desired, one of a series of electrically conductive partitions 107 extends downward from subplatform 102 to gap 101 between each adjacent pair of waveguides 97, the partitions being aligned in parallel relationship with the waveguides. A similar partition 107' extends downward from subplatform 102 between each side panel 99 and the adjacent one of the waveguides 97, partitions 107' being spaced from the side panels to define a cavity trap 108 for suppressing microwave energy release as will hereinafter be discussed in more detail.

In operation, microwave energy generated by magnetrons 96 is emitted from slots 98 of waveguides 97 and is channeled down towards pavement 86 by partitions 107. The microwave energy is then absorbed by the underlying pavement 86 in which process the energy is converted to heat. Thus as the applicator vehicle 83 is traveled along a strip of pavement 86 asphalt liquefaction is brought about in successive incremental areas of the pavement after which the constituents may readily be remixed, regraded and recompacted in the manner hereinbefore described.

The alignment of the waveguides 97 in the direction of vehicle travel in this example, as opposed to the transverse waveguide alignment in the previous example, has the advantage of enabling an optimized nonuniform application of microwave energy to the pavement 86 from front to rear. As is known in the art, a variation in the amount of microwave power emitted from successive portions of each waveguide 97 may be arranged for by providing slots 98 along successive portions of the waveguide which have configurations and locations selected for this purpose. For example if the slots 98 are made progressively shorter from the front to the rear of the waveguides 97 the amount of power radiated from successive portions of the waveguides will decrease from front to rear. This capability of being able to provide for a more intense microwave field at the front portion of the vehicle relative to the more rearward portion can speed the process of pavement decomposition, enabling faster vehicle travel. In particular, the coupling efficiency of microwave energy to most asphalt pavements increases as a function of the temperature of the pavement. Thus it may often be advantageous to proportion the waveguide slots 98 so that power emission decreases towards the rear portions of the waveguides and is relatively high towards the front portions. In such a construction a proportionately larger amount of the generated microwave energy is applied to the colder area of the pavement which requires a larger power input in order to be heated at a given rate.

While alignment of the waveguides 97 with the direction of vehicle travel has the advantage discussed above, it also has a disadvantage in that uniform heating in the transverse direction across the pavement is more difficult to maintain and if an individual one of the magnetrons 96 should malfunction then a largely unheated narrow strip of pavement may result. This does not occur where the waveguides are oriented transversely as in the previously described embodiment of the applicator. If one of a series of transverse waveguides should cease emitting microwave energy or release energy at a decreased rate, there is simply a relatively small reduction in the heating of the entire strip of pavement being treated which can be quickly detected by temperature monitoring means and which condition can be immediately rectified if desired simply by slowing the rate of travel of the vehicle. Thus the matter of aligning the waveguides in the direction of vehicle travel or transversely to such travel is a question of evaluating the above-described advantages and disadvantages of each and the preferred arrangement may vary from job to job depending on specific conditions.

The modified applicator vehicle 83 of FIGS. 9 to 11 also differs from the example earlier described in that the waveguides 97 are situated a greater distance above the pavement 86 and are somewhat less efficient as an energy transfer means, but have the advantages of more uniform heating of the pavement and greater penetration into the pavement.

Considering now the trapping means which suppresses release of microwave energy outward from the vehicle at the gap 101 between the microwave applicator elements and the pavement, the embodiment of FIGS. 9 to 11 employs two forms of trapping means which differ somewhat in form and mode of operation from the corresponding components of the previously described embodiment. The first such trapping means is the cavity trap 108 which, as described above, is defined by the outermost partitions 107', the lower portion of the adjacent side panel 99 and the portions of subplatform 102 situated therebetween. The cavity trap 108 extends along both sides of the vehicle and across the front and the back thereof outwardly from the assembly of waveguides 97. To define the inner boundary of the cavity trap at the front and back of the vehicle electrically conductive cross panels 109 extend across the ends of the partitions 107 and 107' at the front and back of the waveguide assemblies.

Thus the cavity trap 108 constitutes an inverted box-like structure formed of electrically conductive material which is open at the bottom and of which the lower edges are situated close to the underlying pavement 86. A microwave energy-trapping effect is realized inasmuch as energy which propagates outwardly under the lower edge of the conductor member, such as outer partition 107', that defines the inner boundary of the trap does not simply flow in a linear manner under the corresponding outer boundary of the trap formed by side panel 99. Instead, as previously described, such energy in effect attempts to spread outward in all directions from the nominal direction of travel. That portion of such energy passing under panel 107' which spreads downwardly into the pavement 86 is immediately absorbed and converted to heat. The portion of the energy which spreads upwardly is reflected by the conducting walls of the cavity trap. A very large proportion of the various possible paths of such reflected energy eventually enter the pavement 86 after one or more reflections and energy traveling such paths is ultimately directed downwardly into the pavement 86 and is absorbed. Thus the proportion of the energy which passes under partition 107' that can also progress out under side panel 99 is very small.

Additional cavity traps 108 may be provided to further suppress microwave release. In many cases it is desirable to supplement the cavity trap with a different form of trapping means for back-up protection and to guard against specialized conditions which may adversely affect a specific type of trap. For these purposes a supplementary energy-trapping means which is termed a brush trap 111 is provided in the applicator 83 of FIGS. 9 to 11. A first such brush trap 111 is disposed at the outer side of each side panel 99 and also extends across the front and back of the microwave region along the outer side of cross panels 110 which extend between the front and back ends of partitions 107'. The brush trap 111 may consist of angle members 112 which, in conjunction with the lower portion of side panels 99 and the lower portions of front and rear cross panels 110, forms an electrically conductive housing of inverted U-shaped cross section. Within the housing defined by such members, a mass of flexible electrically conductive resilient small wires 113 are disposed with the upper ends of the wires being attached to angle member 112. The individual wires, which may be of resilient steel for example, have a length slightly greater than that needed to reach the underlying pavement 86 or adjacent ground surface so that as best seen in FIG. 11 the lower ends of the wires are deflected by contact with the pavement or other surface and ride along such surface as the vehicle travels. As the interstices between the individual wires in the mass of such wires are far below cut-off dimensions for the microwave frequency used in the applicator, the volumes of wire form a microwave barrier which can extend and contract to accommodate to small surface irregularities in the underlying pavement.

Although the trapping means of applicator 83 as described to this point are operative under virtually all ordinary circumstances to prevent the escape of any significant amount of microwave energy, the importance of assuring this result is such that it is often desirable to provide what might appear to be highly redundant trapping arrangements. To provide still further assurance against the release of microwave energy, the applicator 83 of FIGS. 9 to 11 carries still another brush trap 111' which extends along both sides of the vehicle laterally outwardly from the first brush trap 111 and which also extends across the front and the rear of the vehicle. The basic construction of brush trap 111' may be similar to that of trap 111 as previously described except that the portions which extend along the sides of the vehicle are secured to the lower edges of electrically conductive supplemental side panels 116. Each supplemental side panel 116 is spaced outward from the panel 99 at the same side of the vehicle. The upper portion of each supplemental panel is angled towards the adjacent side panel 99 and is coupled thereto through hinges 117. Thus brush trap 111' may swing upwardly and outwardly and downwardly and inwardly relative to the main body of the vehicle as may be necessary to accommodate to localized elevational variations in the surface along which the vehicle travels. These are particularly likely to be encountered along the edges of pavement 86 where the side portions of the vehicle may travel at times since, as indicated by dash line 118 in FIG. 9, the shoulders of roadbeds are often at a slightly different elevation than the adjoining pavement surface 86. To maintain the brush traps 111' at the proper level relative to road shoulder 118 or the like, support wheels 119 may be journaled to the supplemental side panels 116 to ride along such shoulders.

As best seen in FIG. 10 in particular, the ends 121 of brush trap 111' including the ends 122 of hinged supplemental side panels 116 are angled to extend a distance into the space between the fixedly mounted portions of brush traps 111 and 111' that extend transversely across the front and back portions of the vehicle. This maintains efficient microwave containment at the corners of the vehicle at such times as the hinged outer brush trap 111' may swing outwardly or inwardly in response to variations in the elevation of the underlying surface.

It should be observed that the hinged supplemental side panels 116 in conjunction with the fixed side panels 99 function as a supplementary cavity trap as well as being a support means for the outer brush trap 111'.

It should be understood that the specific forms of microwave energy trapping means as used on the above-described two examples of a microwave applicator vehicle can be interchanged or used in varying combinations and larger numbers of such traps may be provided on a given applicator vehicle where extremely rough pavement or other conditions make it desirable. Other forms of trapping means for suppressing the release of microwave energy at the gap between the vehicle structure and the underlying surface are also possible, one example of which is depicted in FIGS. 12, 13 and 14 in conjunction.

Figures 12, 13, 14:
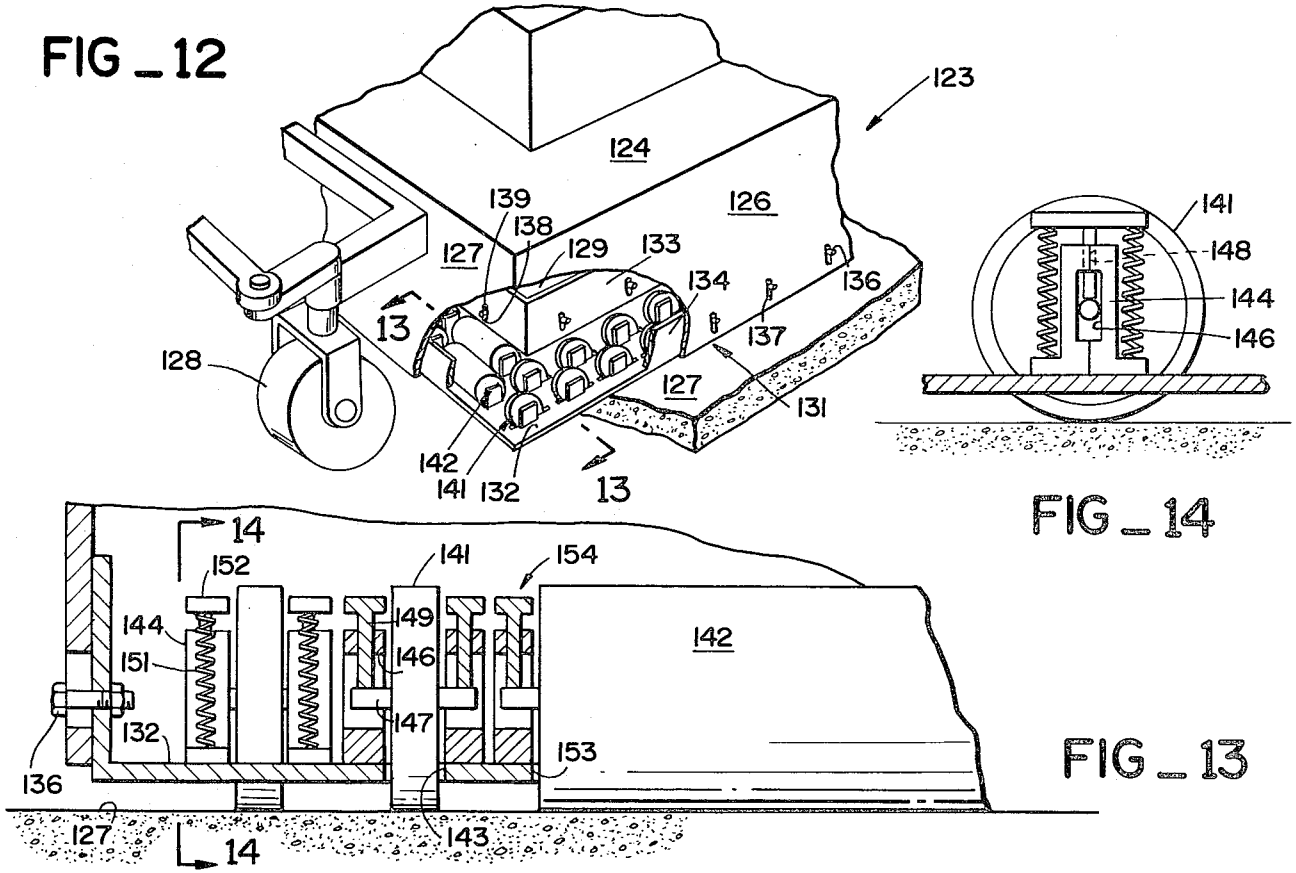
FIG. 12 is a broken-out perspective view of a front corner portion of a third form of microwave applicator vehicle having a modified form of microwave energy-trapping means.
FIG. 13 is a partial cross-section view taken along line 13—13 of FIG. 12.
FIG. 14 is a section view taken along line 14—14 of FIG. 13.

Referring initially to FIG. 12, the microwave applicator vehicle 123 itself, apart from the trapping means, may be of one of the forms hereinbefore described and thus may include a rectangular platform 124 and side panel members 126 and front and back cross panel members 127 which extend downward from the edges of the platform towards the underlying pavement 127 and which members collectively form an inverted rectangular boxlike structure of electrically conductive material. The above-described structure may be supported by road wheels 128 which enable travel along pavement 127 in the manner previously described. An inner electrically conductive inverted boxlike enclosure 129 of less length and width than platform 124 may contain microwave generation and emission structure of one of the forms previously described. Side panels 126 and cross panels 127 do not extend completely down to the surface of pavement 127 in order that the vehicle may override irregularities in the pavement and thus a small gap 131 is present between the above-described structure and the pavement. Release of significant amounts of microwave energy through this gap must be prevented.

For this purpose a flat rectangular open-frame trap panel 132 of electrically conductive material, such as dimpled steel sheet metal, is disposed in the space between microwave enclosure 129 and side panels 126 and between the microwave enclosure and the cross panels 127 at the front and back of the vehicle, the trap panel 132 having dimensions conforming to such space in order to close the lower boundary of this region. Trap panel 132 has an upturned inner edge portion 133 abutted against the side surfaces and front and back surfaces of microwave enclosure 129 and also has an upturned outer edge portion 134 abutted against the inner surfaces of side panels 126 and front and back cross panels 127. While trap panel 132 effectively defines an electrically conductive surface spanning the space between the microwave enclosure 129 and the panels 126 and 127 of the vehicle it is also capable of limited independent vertical movement relative to such components. To define limits to the extent of such movement, a series of spaced-apart vertically oriented slots 137 are provided along the lower portion of side panels 126 and cross panels 127. One of a series of bolts 136 extends outwardly from each upturned edge 134 of panel 132 through each of the slots 137. Similarly, a series of spaced-apart vertical slots 138 are provided along the inner upturned edge 133 of the trap panel and bolts 139 extend outwardly from microwave enclosure 129 through such slots.

In the absence of further arrangements, trap panel 132 would drop down into contact with the pavement 127 and ride along the surface of the pavement, a condition which could cause rapid wearing of the panel. Panel 132 is supported a small distance above the pavement by a series of wheels 141 mounted along the side portions of the panel and by a series of rollers 142 mounted along the front and back portions of the panel. In this example, there are two longitudinal rows of wheels 141 along each side portion of the panel 132. Individual wheels 141 of the two rows have parallel but spaced-apart rotary axes so that, viewed from the side of the vehicle, the wheels of one column are centered in the spaces between adjacent wheels of the other column.

The rollers 142 are also disposed in two columns along both the front and back portions of trap panel 132 in a staggered relationship so that when viewed from the front or back of the vehicle, the rollers of one column overlap two adjacent ones of the rollers of the other column. As will hereinafter be discussed in more detail, the wheels 141 and rollers 142 have an electrical function in suppressing the emission of microwave energy as well as serving to support the panel 132 and the reasons for the above-described placements of the wheels and rollers will be discussed in connection with the electrical operation of the trap.

Considering now means for supporting the individual wheels 141 and rollers 142, with reference to FIGS. 13 and 14 in particular, the lower portion of each such wheel extends downward through a conforming slot 143 in panel 132. At each side of each wheel a support bracket 144 is secured on panel 132 and each such bracket has a vertical slot 146 into which a short axle 147 extends from the ajacent side of the associated wheel 141. Each bracket 144 has a vertical passage 148 extending upward from the top end of slot 146 and a rod 149 extends down through the passage and bears downwardly against the wheel axle 147 within the slot. A pair of tension springs 151 are connected between the base of each bracket 144 and a cross member 152 at the top of the rod 149 of that bracket to urge the rod downward.

The rollers 142 at the front and back portions of trap panel 132 have lower portions which extend downward through conforming openings 153 in the trap panel to contact the underlying pavement 127 and are retained in place and urged downwardly by bracket assemblies 154 similar to those described above in connection with the wheel 141 support means.

Accordingly, the trap panel 132 is supported by the wheels 141 and rollers 142 and rides along the pavement on such elements while being constrained to travel with the rest of the applicator vehicle. As the trap panel 132 is capable of a limited amount of independent vertical movement as determined by slots 137, it may self-adjust as necessary to maintain a predetermined small vertical spacing from the pavement including at times when the other components of the vehicle may rise slightly due to a road wheel passing over an elevated portion of the surface.

Considering now the microwave energy-trapping action of the above-described structure, it may be seen that the trap panel 132 in conjunction with the underlying electrically lossy pavement 127 is basically a gap trap of the general type previously described. Moreover, it is a highly efficient one as a very close spacing of the underside of panel 132 from the pavement 127 may be established and maintained since the panel rides on its own wheels 141 and rollers 142 rather than being supported by the main road wheels of the vehicle and is capable of limited independent vertical movement relative to the rest of the vehicle. Further, there is still another trapping effect additional to the basic gap trap mode of operation.

In particular, the wheels 141 and rollers 142 may be formed at least in apart of electrically conductive material and may be spaced apart a distance smaller than the cut-off dimensions for the particular microwave frequency employed in the applicator vehicle. The lower portions of the wheels 141 and rollers 142 which extend below the trap panel 132 are then, in effect, spaced-apart conductive elements that break up the gap 131 between the panel 132 and pavement 127 into a network of intersecting passages no one of which has horizontal or vertical dimensions sufficiently large to allow outward propagation of a sizable amount of microwave energy. Further, this condition is maintained when an individual wheel 141 or roller 142 passes over a localized crack, depression or other declivity in the pavement. Gravity, reinforced by springs 151 in this example, then causes that wheel or roller to move downwardly into the crack or the like to prevent any opening through the trap, of greater than cut-off dimensions, from being established. Similarly, if a wheel 141 or roller 142 should override a localized raised area such as a small stone lying on the pavement, it does not result in the entire panel 132 being lifted. Instead, only the particular affected wheel 141 or roller 142 rises.

Figure 15:
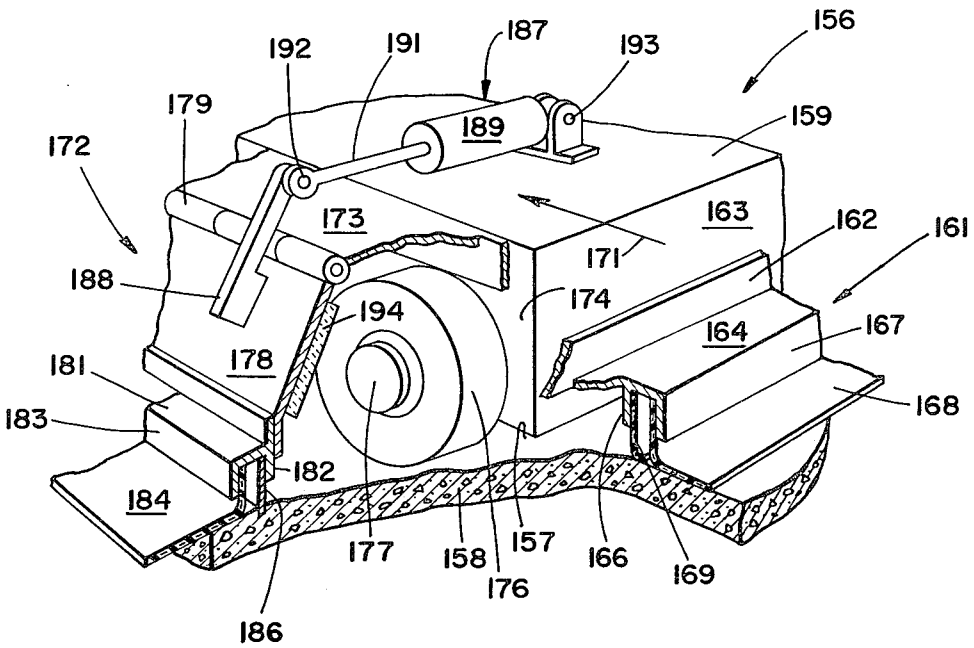
FIG. 15 is a broken-out perspective view of the left rear corner of still another form of microwave energy applicator vehicle.

FIG. 15, depicting the left rear corner of still another microwave applicator vehicle 156, illustrates still other forms of microwave energy trapping structure for inhibiting the release of microwave energy at the gap 157 between the underside of the vehicle and the underlying pavement 158 or between the underside of the vehicle and the underlying earth in instances where the side of the vehicle is riding along a road shoulder.

Applicator vehicle 156 may have a rectangular body 159 containing microwave generation and application conponents of the form hereinbefore described with reference to preceding embodiments. The following description will therefore be confined to the modified microwave energy trapping means and a modified disposition of road wheels on the vehicle which enables the road wheels to be utilized as a component of the trapping means if desired and which may also enable a shortening of the transverse dimension of the vehicle in some circumstances.

In particular, applicator vehicle 156 carries transverse trapping structures across the front and back which are of a form termed skirt traps 161, the rear skirt trap being depicted in FIG. 15. The rear skirt trap 161 may include a transverse member 162 formed of electrically conductive material which extends along the back surface 163 of the body 159 of the vehicle at a level a small distance above the gap 157. Member 162 includes a flat shelf 164 which extends a distance outwardly from the back surface 163 of the vehicle and has spaced-apart parallel skirt carrier elements 166 and 167 which extend downward from the underside of shelf 164 to gap 158. Member 162, shelf 164 and skirt carriers 166 and 167 are each formed of steel or other electrically conductive material and if desired may be a single integral element.

Propagation of microwave energy in the backward direction from the vehicle through gap 158 is blocked by flexible skirts 168 and 169 which extend downward from carriers 167 and 166 respectively to contact the pavement 158 and which are preferably of sufficient length to cause the lower portions of the skirts to deflect and drag along the surface of the pavement as the vehicle travels in the forward direction as indicated by arrow 171. The rearmost skirt 168 may, if desired be lengthier than the forward skirt 169. In addition to being flexible, the skirts 168 and 169 are formed at least in part of a material which is electrically conductive so that microwave energy is not transmitted through the skirts but is instead reflected. While the skirts 168 and 169 may simply be formed of flexible resilient metal sheeting, other constructions may also be used such as laminations of wire screen or mesh embedded in rubber or other flexible material. As the rear skirt trap 161 must travel over the heated pavement, heat-resistant materials should be employed in forming the skirts.

As the skirts 168 and 169 reflect microwave energy, any such energy attempting to propagate backwardly through the trap 161 is redirected back towards the body of the vehicle or else downward into the highly lossy pavement 158 where it is absorbed.

As will be apparent, an essentially similar skirt trap may be utilized across the front of the applicator vehicle 156 although in that case the travel of the vehicle causes the rear portions of the skirts 168 and 169 to bend back towards the vehicle rather than away from the vehicle as in the case of the rear trap 161.

Considering now the trapping means 172 disposed along the sides of the applicator 156 of FIG. 15, an electrically conductive shelf 173 extends a distance outwardly from the side panel 174 of the applicator vehicle at a level sufficiently high, in this example, to extend over the road wheels 176 which support the vehicle for travel along the pavement, the road wheels being journaled to the vehicle body 159 on suitable axles 177. An electrically conductive adjustable panel 178 extends outwardly and downwardly from the outer edge of shelf 173 with the two members being linked together by hinge means 179 that enables the panel 178 to swing upwardly and downwardly relative to the shelf. Disposed along the lower edge of side panel 178 is an electrically conductive member 181 having spaced-apart parallel skirt carrier portions 182 and 183 extending downward to gap 157. The upper inner edge of a first side skirt 184 is secured to the outermost carrier 183 and the lower portion of the skirt 184 bends outwardly from the vehicle and extends for a distance outwardly to drag along the underlying pavement 158 or along the underlying earth or gravel in the case of a road shoulder. Skirt 184 is flexible and formed at least in part of electrically conductive material as previously described in connection with the rear trap 161 and thus functions to suppress the release of microwave energy from the vehicle in the sideward direction.

The skirts utilized in the above-described skirt traps need not necessarily be of the form, described above, in which the skirts are highly flexible and in which a sizable portion of the skirts lie flat against the underlying pavement. The inner skirt 186 of the side trapping means 172 in this example, is a rigid metallic strip which extends downward from carrier 182 in a vertical direction to the underlying pavement or earth. Inner skirt 186, which is replaceable upon wearing of the lower edge, is particularly useful in a side trap designed to travel along the relatively soft earth or gravel of a road shoulder as the lower portion of such a skirt may readily be caused to cut a small distance down into the soft underlying surface and thereby provide a highly effective microwave trapping barrier. To enhance this mode of trapping and to enable the accommodation of the side trapping means 172 in general to situations where a road shoulder may not be precisely at the same level as the adjacent pavement, means 187 for controlling the vertical spacing of the side skirt trap 172 relative to the underlying surface may be provided. In this example such means 187 includes an arm 188 extending upwardly from the outside of hinged panel 178 and a hydraulic actuator 189. Actuator 189 has a retractable and extendable rod 191 coupled to the upper end of arm 188 through a pivot joint 192 and has a head end coupled to the vehicle body 156 through another pivot connection 193. Thus contraction of actuator 189 swings hinged panel 178 outwardly and upwardly to raise the side skirt trap 172 while extension of the actuator lowers the trap.

It has been pointed out in connection with previously described embodiments, that the electrically conductive members such as 173, 178 and 182 in this example which support the outermost trapping means 172 may also, in effect, constitute a cavity trap of the kind previously described. Thus microwave trapping action in the side trap 172 of FIG. 15 is not limited to the skirts 184 and 186 but is supplemented by the fact that members 173, 178 and 182 in effect define a cavity trap of the type hereinbefore discussed. The ability of a cavity trap to suppress the release of microwave energy may be enhanced by lining at least portions of the inner surface of the cavity with a layer of lossy or microwave absorbent material which in this example is an iron oxide slab 194 disposed against the inside surface of hinged panel 178. Other known electrically lossy materials, such as rubber, various ceramics or containers of water formed of non-conductive material, for example, may also be disposed in a cavity trap to function as a microwave absorber. Still further, the disposition of the road wheels 176 of the vehicle within the cavity trap defined by members 173, 178 and 182 still further enhances the suppression of microwave energy release if portions of the wheel itself are formed of electrically lossy material as is often the case. Rubber, for example, is a lossy substance.

Figure 16:
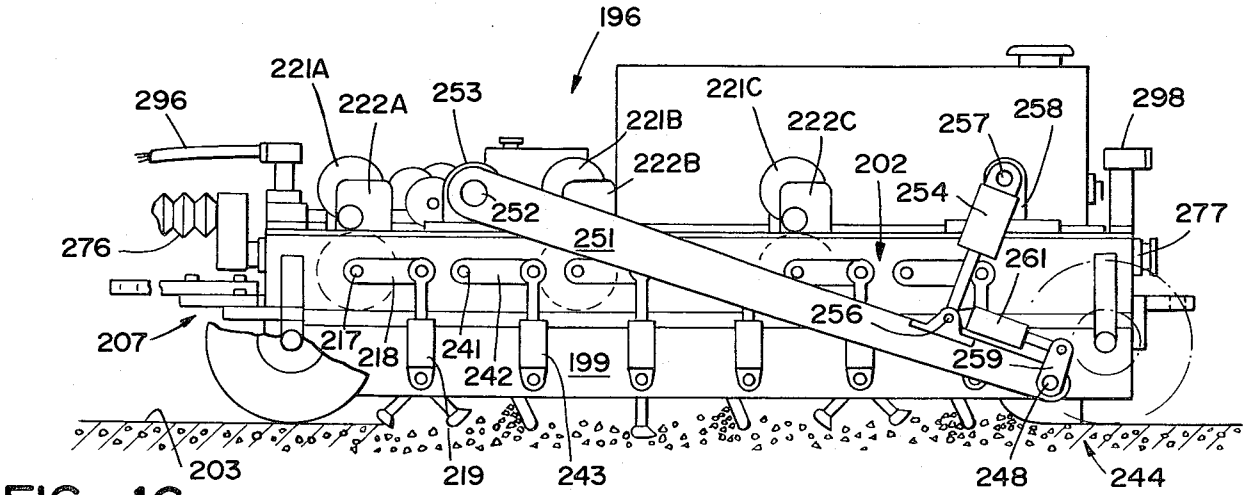
FIG. 16 is a side elevation view of a tiller compactor vehicle for use in the practice of the invention.
Figure 17:
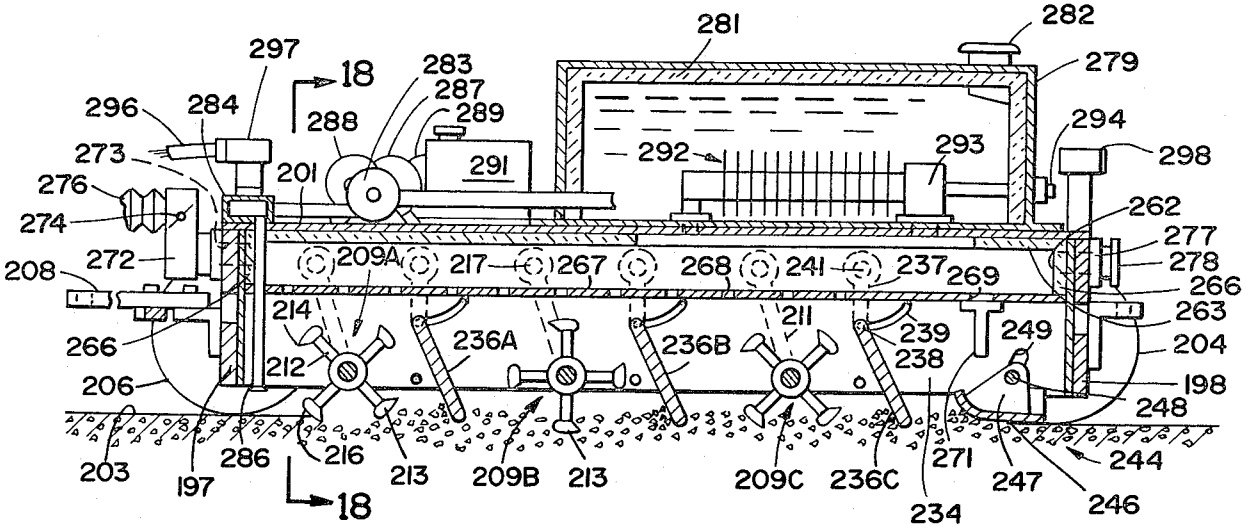
FIG. 17 is an elevation section view of the tiller compactor vehicle of FIG. 16.

It has been pointed out how microwave applicator vehicles of the general kind described above may be used with additional conventional forms of construction equipment to accomplish the on-site recycling and repaving of an existing asphalt road or other paved area. Under many conditions, greater efficiency may be realized by using one of several forms of integrated road-paving recycling system in which mechanisms and components for accomplishing the microwave heating, remixing, grading and compacting steps are partially or wholly combined into a specialized vehicle assembly. FIGS. 16 and 17 in conjunction depict one example of a tiller-compactor vehicle 196 which may be utilized to follow a microwave applicator vehicle in order to perform the mixing, grading and at least a portion of the compacting steps of the method.

The tiller-compactor vehicle 196 may have front and rear transverse frame members 197 and 198 respectively, side frame members 199 and a rectangular platform 201 disposed above the frame members which in conjunction form an inverted rectangular boxlike vehicle body 202 adapted to travel along the pavement 203 which is to be relaid. The vehicle body may be supported on a pair of rear road wheels 204 and a pair of front road wheels 206 which are preferably steerable through conventional wagon steer linkage 207 coupled to a pivotable towing tongue 208 mounted at the center of the front of the vehicle. If the vehicle is not designed to be towed, it may be provided with an engine, drive system and control means of suitable known forms.

The tiller-compactor 196 follows behind a microwave applicator vehicle which has heated the pavement 203 to a temperature at which it is readily crumbled and at which it may easily be remixed by stirring, raking, tilling, plowing or other similar operations. This remixing is effected in the present example by three rotary tillers 209A, 209B and 209C carried within the body 202 of the vehicle with tiller 209A being situated near the front of the vehicle and being followed at intervals by tillers 209B and 209C. Each such rotary tiller 209 is supported by a pair of pivotable arms 211 situated one at each side of the vehicle and each tiller has radially extending blades 212 carrying pavement cutting, mashing and stirring heads 213. The tillers preferably turn counterclockwise as viewed in FIG. 17 and the heads 213 have a sharp leading or cutting edge 214 followed by a rounded heel 216. This head construction causes the tillers to shave off successive increments of the heated pavement and to exhibit a lump-mashing effect as well as accomplishing a general stirring or remixing of the pavement constituents.

To provide for selective adjustment of the vertical level of each tiller 209 relative to pavement 203 in order to control the cutting and mixing depth, the upper ends of the tiller supporting arms 211 are coupled to axles 217 which extend through side frame members 199, as best seen in FIG. 16, and a crank arm 218 extends radially from each such axle at the outside of the side frame members. A hydraulic actuator 219 is coupled between each such crank arm and the side frame member 199 enabling each tiller to be raised or lowered by extension or contraction of the associated actuators 219. Although hydraulic actuators or cylinders, such as actuator 219, are used to accomplish a controlled movement of various elements in the embodiments of the invention which are described herein, it will be apparent that electrically operated actuators may be substituted for such devices if desired.

Each tiller 209A, 209B and 209C is driven by an associated one of three electrical motors 221A, 221B and 221C respectively through an associated one of three speed reduction gear units 222A, 222B and 222C respectively. Referring momentarily to FIG. 18, drive may be transmitted to each tiller, such as the front tiller 209A, through a compound gear 223 having a large-diameter gear portion 224 the upper end of which extends through a slot in platform 201 to engage the output gear 226 of speed reduction unit 222A. To support compound gear 223, axle 217 may extend inwardly to a bearing 227 which is secured to a gas manifold sidewall 228 that extends downward from the underside of platform 201. Compound gear 223 is rotatable relative to the supporting axle 217 and has a smaller-dimeter gear portion 229 which is coupled, by means of a chain 231, with a drive gear 232 which is mounted on the end of the tiller blade support and drive shaft 233. To protect the above-described drive and vertical adjustment mechanisms from pavement constituents which may be impelled upwardly and outwardly by the tiller heads 213 and to provide some shielding of such components from the hot gas which is directed to the pavement constituents during the remixing operation, a panel 234 preferably formed of thermally insulative material extends downward from gas manifold side member 228 between chain 231 and the adjacent end of the tillers.

Referring again to FIGS. 16 and 17 in combination, the remixing operation is enhanced by three drag blades 236A, 236B and 236C situated behind tillers 209A, 209B and 209C respectively. Each such drag blade may be of flat rectangular configuration and has an upper end coupled to a pair of support arms 237 through pivot couplings 238. Drag blade support arms 237 are situated adjacent the inner surfaces of side frame members 199 of the vehicle and slots 239 are provided in panel 234 to enable the pivot couplings 238 to extend through such panels to connect with the support arms 237 and to allow pivoting of the support arms for the purpose of adjusting the level of the lower ends of the drag blades. The support arms 237 are in turn secured to axles 241 which are journaled in the side frame members 199 and which extend to the outer surface of the vehicle body where, as best seen in FIG. 16, a crank arm 242 extends radially from each axle and a hydraulic actuator 243 is coupled between the end of the crank arm and the lower portion of side frame member 199 to enable controlled raising and lowering of the drag blades. Referring again to FIG. 17 in particular, the drag blades 236 are proportioned in the vertical direction to enable each drag blade to extend downward and backward into the decomposed pavement so that the blade tends to be inclined. The drag blades 236 intercept pavement constituents which may be impelled backward by the action of the tillers 209, act to mash lumps which may be present in the paving material and act to grade the material following each remixing stage.

To perform a final grading and to compact the remixed pavement constituents, a screed 244 rides along the surface underlying the vehicle behind the rearmost drag blade 236C. Screed 244 may consist of a transverse member 246 having a flat undersurface which curves upwardly at the forward edge to receive and compress the remixed pavement constituents.

These operations are best accomplished if the screed member 246 is supported in such a manner that it may be controllably raised and lowered relative to the vehicle body so that the downward pressure which the member exerts on the remixed pavement constituents may be adjusted. It is often preferable that the undersurface of the screed member 246 be slightly inclined with the more forward portion being slightly elevated relative to the trailing edge and it is also preferable that this inclination or angle of attack be adjustable. In order to support the screed member 246 while providing for these adjustments, brackets 247 extend upward from the top surface of the screed member to connect with a transverse support shaft 248 which has ends extending through slots 249 in the side paneling of the vehicle body. As best seen in FIG. 16, the opposite ends of the support shaft 248 protrude a short distance from each side of the vehicle body and extend through the back ends of a drag arm 251 at each side of the vehicle. The forward ends of drag arms 241 are coupled to the forward part of the vehicle through pivot couplings 252 which connect with brackets 253 situated on platform 201. To provide for controlled raising and lowering of the level of the screed 244 a hydraulic cylinder 254 is connected between each drag arm and the body of the vehicle through a pivot coupling 256, on the drag arm, and another more elevated pivot coupling 257 attached to a bracket 258 which is secured to the platform 201. To enable control of the inclination or angle of attack of the screed 244, a crank arm 259 extends radially from each end of screed support shaft 248 and one of another pair of hydraulic actuators 261 is connected between the end of each crank arm and each pivot coupling 256.

Referring to FIGS. 17 and 18 in combination, arrangements for directing hot gas into the pavement constituents and to structural components which contact the hot decomposed pavement include a rectangular gas manifold chamber 262 situated below platform 201. The top of manifold chamber 262 is defined by the undersurface of platform 201 including a layer of thermal insulation 263 which is preferably disposed against the undersurface of the platform. The side portions of the manifold chamber 262 may be defined by the previously described manifold members 228 which may also have a layer 264 of thermally insulative material against the inner surfaces while the front and back of the chamber may be defined by front and back transverse frame members 197 and 198 respectively with layers of thermal insulation material 266 again being disposed along the inner surfaces of such members. The bottom surface of the manifold chamber 262 is formed by a flat panel 267 situated a sufficient distance above the tillers 209 and drag blades 236 to provide for the previously described vertical adjustment of such components.

A series of transverse slots 268 in panel 267 provide for the release of hot exhaust gas downwardly into the region of each tiller 209 and drag blade 236 and a final slot 269 directs such gas to a linear nozzle 271 which applies a stream of the hot gas along the upper surface of screed member 246. Maintaining the screed member 246 at a high temperature in this manner improves the action of the screed in that pavement constituents including asphalt do not tend to adhere to a metallic surface which is heated to a temperature sufficient to cause asphalt to act more or less in the manner of a lubricant. The commonly observed tendency of an asphaltic composition to adhere or stick to certain surfaces is an effect which occurs at lower temperatures at which the asphalt is in the process of solidifying.

In instances such as this example where the tiller-compactor structure is not self-propelled and is not an integral part of a larger vehicle containing other components for practicing the invention, the hot exhaust gas is received from another vehicle which tows the tiller-compactor. For this purpose of gas receiver chamber 272 may be mounted on the front of the tiller-compactor vehicle and is communicated with manifold chamber 262 by a passage 273 through the front frame members 197 of the vehicle. Receiver chamber 272 may contain valving means 274 for adjusting flow rate. A conduit 276, preferably formed of thermally insulative material, extends forward from receiver chamber 272 to transmit hot exhaust gases to the tiller-compactor vehicle in a manner which will hereinafter be described in more detail. To enable the tiller-compactor vehicle to angle relative to the towing vehicle while traveling around curves and to accommodate to differences in vehicle inclination in traveling variably sloped roadways, the conduit 276 may be of a flexible pleated or bellows form so that it may extend, contract and bend.

Under some circumstances the tiller compactor vehicle may itself tow another vehicle of the same kind or of another kind, such as a roller compactor for example, that may also require hot exhaust gas. For this purpose an outlet fitting 277, communicated with manifold 262 but normally closed by a cover 278, may be provided at the back end of the vehicle.

To provide for the addition of supplementary asphalt, paving oils, or liquid conditioners to the decomposed pavement constituents prior to or during remixing, a tank 279 is carried on platform 201 and may have a lining 281 of thermally insulative material, except along the bottom surface, and may also have a filler spout 282. Heated asphalt or other liquid from the tank may be withdrawn and applied to the pavement constituents by a pump 283 having an intake pipe extending into the lower region of the tank and having an outlet pipe communicating with a flow manifold 284 which extends transversely across the front portion of platform 201. A series of spray nozzles 286 extend downward from manifold 284 to apply the hot asphalt or the like to the heated pavement in front of the initial tiller 209A in this example. The supplementary asphalt of the like, where needed, may also be applied in front of any or all of the additional tillers 209B and 209C if desired by rearranging the position of nozzles 286 to such locations or by providing additional nozzles.

Asphalt pump 283 may be driven by an electrical motor 287 through a speed reduction device 288 and the electrical motor may also drive another pump 289 which pressurizes hydraulic fluid from a tank 291 to operate the several previously described hydraulic actuators on the vehicle.

Supplementary asphalt as well as other conditioners or the like which may be carried in tank 279 should in most cases be maintained in a heated condition. The insulation layer 281 in tank 279 may in some cases be sufficient for this purpose, particularly if such insulation is absent from the floor of the tank and if the insulation 263 below platform 201 is also absent from an area below the tank. Heat is then readily conducted upward to the liquid in the tank through the subjacent area of platform 201. However, in some circumstances it may be desirable to provide for a supplementary heat input to the asphalt tank 279. This may be accomplished by disposing a heat exchanger 292 within tank 279 which has opposite ends communicated with the exhaust gas manifold 262. As exhaust gas within the heat exchanger 292 cools through heat conduction to the contents of tank 279, convection effects cause the relatively cool gas to descend back into manifold 262 while being replaced with hotter gas from the manifold. By providing a valve 293 at one or both ends of the heat exchanger, controllable by a handle 294 situated outside of the tank, the extent of this convection interchange may be regulated to thereby regulate the temperature within the tank 279. In instances where this does not provide a sufficient degree of regulation, valve 293 may be replaced by a powered blower for producing a precisely controllable flow of hot gas through the heat exchanger 292.

Electrical power for operating the several electrical components of the tiller-compactor vehicle 196 is received from the towing vehicle through a flexible cable 296 which may connect with a power connector pedestal 297 mounted on the front of the vehicle. To transmit such power on to still another vehicle which may be towed in some circumstances, a similar electrical connector pedestal 298 may be mounted on the rear of the vehicle.

Figure 19:
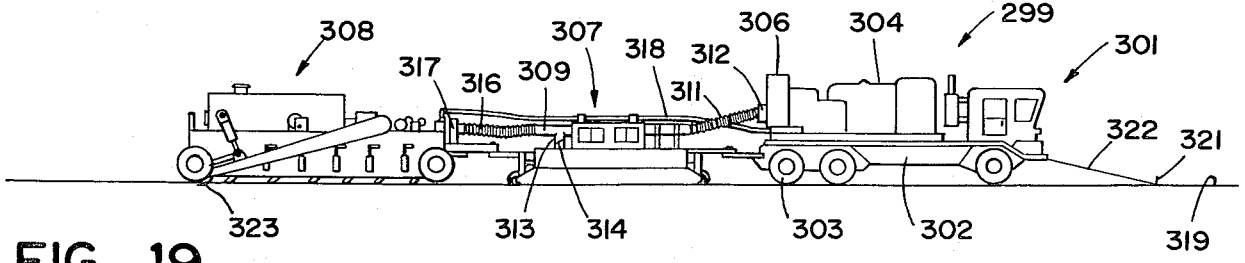
FIG. 19 is a side elevation view of a large road paving recycling system utilizing certain component vehicles similar to those depicted in preceding figures.

Considering now how component vehicles which may be of the forms hereinbefore described may be linked together with integrated to form a road recycling system that may be traveled along a deteriorated road at a slow rate of speed while leaving a repaved and reconditioned road behind, reference should be made initially to FIG. 19. The road repaving system 299 of FIG. 19 includes a propulsion unit 301 which is a large flat-bed automotive truck 302 in this example although other types of self-propelled vehicle may also be employed. The truck 302 should preferably be of one of the known forms of substantial load-carrying capacity and which has multiple drive wheels 303 for providing high traction and which is capable of sustained travel at very low speeds which may typically be of the order of three to twenty feet (or about 1 to 6 meters) per minute for example. To provide electrical power for operating the microwave generators and other electrical components of the system 299, one or more conventional motor generator sets 304 are carried on truck 302 and the hot exhaust from the driving engines of the motor generator sets is collected in a gas housing 306 carried near the back of the truck. In a typical example, two motor generator sets 304 may be present, each being of the diesel engine-driven form and each of which produces three-phase power at 480 volts. If necessary, the exhaust gas of the engine which drives the truck itself may also be collected in gas housing 306.

Truck 302 is coupled to and tows at least one microwave applicator vehicle 307 which may be of one of the forms hereinbefore described except insofar as the applicator vehicle need not carry its own motor generator set. Applicator vehicle 307 is in turn coupled to and tows a tiller-compactor vehicle 308 which may be of the form hereinbefore described in detail.

A thermally insulated hot gas conduit 309 is carried on applicator vehicle 307 and the front end of the gas conduit is coupled to gas housing 306 of the propulsion unit 301 through a flexible bellows pleated thermally insulative conduit 311 that enables angling of the applicator vehicle relative to the propulsion unit as the system travels around curves in the roadbed. A blower 312 may be provided between housing 306 and flexible conduit 311 to enhance the flow of hot exhaust gas and is preferably of the form which allows a controlled dilution of the exhaust gas with cool air to bring the temperature of the gas flow down to the range, typically about 300° F. (150 c.), which is preferred for use in heating the pavement. The hot gas intake ducting 313 of the applicator vehicle is connected into conduit 309 preferably through a valve 314 for regulating the proportion of the hot exhaust flow which is admitted into the applicator vehicle.

Hot exhaust gas is transmitted to the tiller-compactor vehicle 308 through another flexible bellows-pleated conduit 316 which connects the back end of conduit 309 with the gas-receiver chamber 317 of the tiller-compactor.

Similarly, electrical power generated by the motor generator sets 304 is transmitted from the propulsion unit 301 to the applicator vehicle 307 through a flexible electrical cable 318 which also extends further on to transmit electrical power to the tiller-compactor vehicle 308.

In operation, the road repaving system 299 is traveled along the road 319 which is to be repaved and preferably a small upright guide rod 321 is carried on a support 322 that extends forward from truck 302 to enable the operator to follow a guide line marked on road 319. As the system 299 progresses along the road, the old asphalt pavement below applicator vehicle 307 is rapidly heated and decomposed by microwave energy in the manner previously described. The heated pavement is then traversed by the tiller-compactor vehicle 308 which pulverizes, remixes, regrades and recompacts the hot pavement mix also in the manner previously described. In some cases the degree of compaction provided by the tiller-compactor screed 323, which causes a controlled proportion of the weight of vehicle 308 to bear down against the pavement is sufficient to provide the desired repaved road surface. Where further compaction is needed, vehicle 308 may be equipped with a roller which follows screed 323 or a separate roller compactor vehicle may follow the system 299.

The rate at which the system described above can effect the repaving of an asphalt roadway is a function of several factors among which is the microwave power input to the underlying pavement at applicator vehicle 307. Under most circumstances the system is traveled at the maximum speed that is consistent with heating the pavement beneath applicator vehicle 307 to the temperature ranges hereinbefore discussed. This power input to the pavement at the applicator vehicle is ultimately limited by the power-generating capacity of the motor generator sets carried on the propulsion unit 301 but within that limitation the length of the applicator vehicle 307 is also a factor in the power input to the pavement. In general, achieving higher production rates may dictate longer microwave applicator portions of the system. This is also true to some extent of the tiller portion of the system as a series of several tillers or the like may be desired in order to enable faster travel of the system. However, lengthening of the applicator vehicles or the tiller compactor vehicles for such purposes may itself have certain disadvantages under some working conditions.

Figure 21:
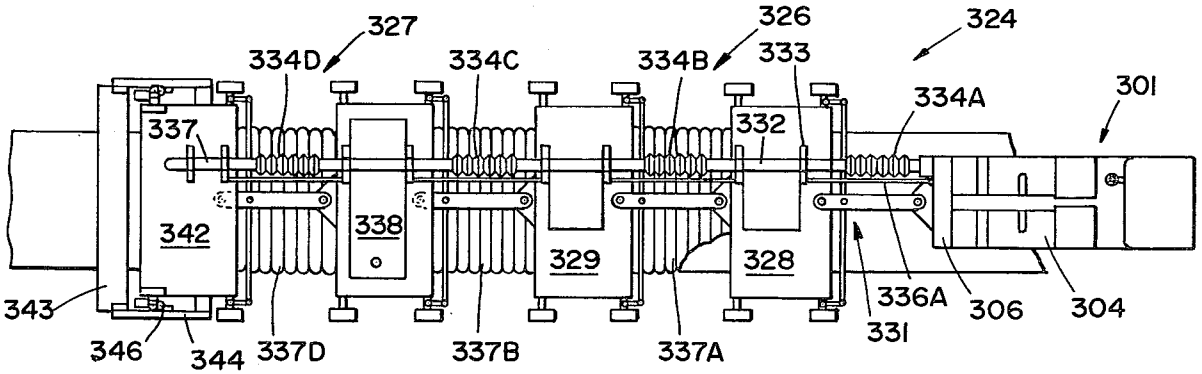
FIG. 21 is a plan view of the system of FIG. 20.
Figure 20:
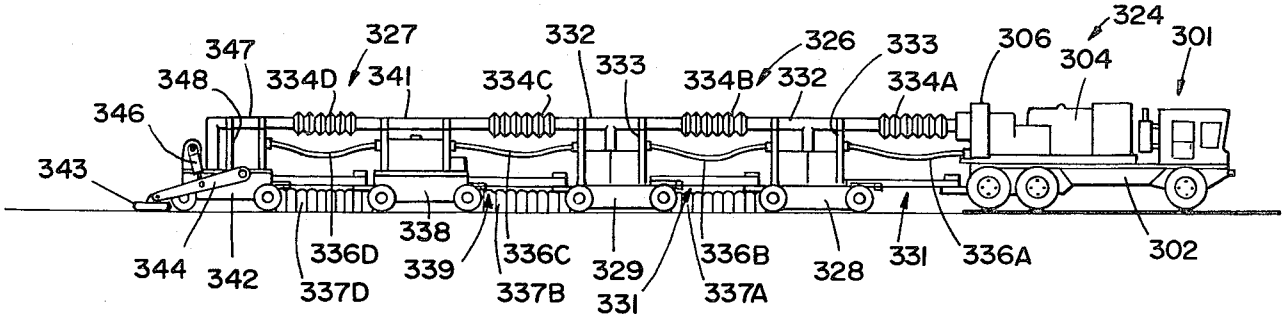
FIG. 20 is a side elevation view of a modified form of large road paving recycling system.

Most notably, both the applicator vehicle and the tiller-compactor vehicle may often be formed to be very broad in order to span an entire roadway or a wide strip of roadway so that the road may be repaved in its entirety with one passage of the system along the roadbed or a small number of such passages. If the applicator and tiller-compactor vehicles are then also made very long to increase productivity, the system is then composed of a series of vehicles which are very bulky and heavy. While that is not necessarily a problem at any one specific job site, it may prove to be difficult to transport the apparatus to different remotely located job sites. A somewhat related factor is that there are a limited number of articulations in the total system as described above and these are separated to an increasing extent if the length of component vehicles is increased. This affects the ability of the successive system components to track precisely behind the propulsion unit. The latter problem may of course be eliminated by providing individualized steering systems at each component vehicle of the system but that requires much of the attention of operators who could otherwise be employed in other capacities in the operation of the apparatus. FIGS. 20 and 21 illustrate a modified form of road repaving system 324 having lengthy microwave application and tiller sections but in which transportation of the equipment between job sites is more easily accomplished, which follows along a preselected track more precisely and which can accommodate to curved roads and undulating roadbeds more readily.

Basically these objectives are realized in the system of FIGS. 20 and 21 by separating the microwave applicator portion of the system and the tiller-compactor portion of the system into a plurality of separate relatively short vehicle sections and, in the process, increasing the number of articulations in the system as a whole.

In particular, the system 324 may employ a propulsion unit 301 which may be a truck 302 carrying a pair of motor generator sets 304 which feed exhaust to a gas housing 306, the propulsion unit being similar to the corresponding portion of the previously described road-repaving system. However, the microwave applicator section 326 of the system 324 and the tiller-compactor section 327 are of modified construction.

The microwave applicator section 326 is comprised of a plurality of component applicator vehicles of which two such applicator vehicles 328 and 329 are utilized in this example although additional ones may be present if desired. Microwave applicator vehicles 328 and 329 may have any of the internal constructions hereinbefore described except insofar as each vehicle is relatively short in the direction of travel, preferably having a length which does not exceed the maximum legal width of loads which are to be carried along public highways on the back of a truck. Although not limitative, vehicle lengths of about six to eight feet (1.8 m. to 2.4 m.) may be most convenient. The towing and steering linkages 331 through which applicator vehicle 328 is coupled to the propulsion unit 301 and through which applicator vehicle 329 is coupled to vehicle 328 may be disassembled and removed during such transport of the equipment.

Each of the applicator vehicles 328 and 329 carries a gas conduit 332 on vertical supports 333 for supplying hot exhaust gas to the microwave heating region as previously described, and sections of flexible bellows pleated gas conduit 334 interconnect the gas housing 306 of the propulsion unit with the conduit 332 of the first applicator vehicle 328 and connect the adjacent ends of the conduits 332 of the two applicator vehicles. Similarly, flexible electrical cables 336 transmit electrical power from the propulsion unit 301 to the first applicator vehicle 328 and then on to the second applicator vehicle 329.

While the repaving system 334 of FIGS. 20 and 21 has the advantage of being disassemblable into relatively small units which may be more conveniently transported and has a large number of articulations to provide greater flexibility in traveling along curves and along roadbeds of varying or undulating gradient, a further result of this construction is that in the absence of counteracting arrangements, the heated pavement would be exposed to the atmosphere and subject to some cooling during the several intervals which intervene between passage of successive components of the system over a given area of pavement. Although such heat loss is not overly severe under many conditions the process is more energy-efficient if cooling is inhibited at these times. For this purpose, a flexible pleated cover 337A, formed of thermal insulation, may be carried between the first applicator vehicle 328 and the following applicator 329. Cover 337A preferably extends downwardly at each side of the heated zone of pavement between the two vehicles as certain of the forms of microwave trapping structure hereinbefore described, such as the gap trap or chain trap for example, enable the hot exhaust gas which is present under the applicator vehicles to enter the region within flexible cover 337 and thereby further inhibit cooling of the pavement.

The tiller-compactor section 327 of the system is also of a sectionalized or modular configuration for reasons similar to those described above with reference to the microwave applicator section. Thus a first relatively short tiller vehicle 338 containing, for example, two of the tiller and drag blade assemblies hereinbefore described may be spaced from the final microwave applicator 329 and may be towed and steered through linkage 339 of the form previously described. Another flexible pleated cover 337B may be carried between the two vehicles to inhibit cooling of the heated and decomposed pavement following passage of the final applicator vehicle and prior to arrival of the initial tiller vehicle. Another gas conduit 341 is carried above tiller vehicle 338 to supply hot gas to the underlying pavement constituents during remixing as previously described, the gas conduit being coupled to the corresponding conduit 332 of the final microwave applicator vehicle 329 through another flexible bellows pleated flexible conduit 334C.

The final tiller vehicle 342 may be essentially similar to the initial tiller vehicle 338 except that it carries the screed 343 for providing the final grading and compaction operation. Screed 343 may be situated behind the body of the final tiller vehicle 342 and may be coupled to the vehicle through pivotable drag arms 344 essentially as previously described. Hydraulic cylinders 346 are coupled to the drag arms 346 to control the vertical level of the screed 343. While the externally mounted screed and supporting and control structures add to the length of the final tiller vehicle 342, such external elements are readily removed when the apparatus is to be trucked to a different work site.

Hot exhaust gas is supplied to the final tiller unit 342 through a final section of insulated conduit 347 carried on vertical supports 348 and coupled to the corresponding conduit 341 of the initial tiller section 338 through another section of bellows pleated flexible conduit 334D. Similarly, electrical power is transmitted back to the final tiller vehicle 342 through still another section of flexible electrical power cable 336D extending forward to the preceding tiller vehicle 338.

The road repaving systems described above with reference to FIGS. 18 to 21 are primarily designed for large-scale operations. Smaller systems having considerably different vehicle configurations may also be utilized in the practice of the invention, a first example of which is depicted in FIGS. 22 and 23.

Figure 23:
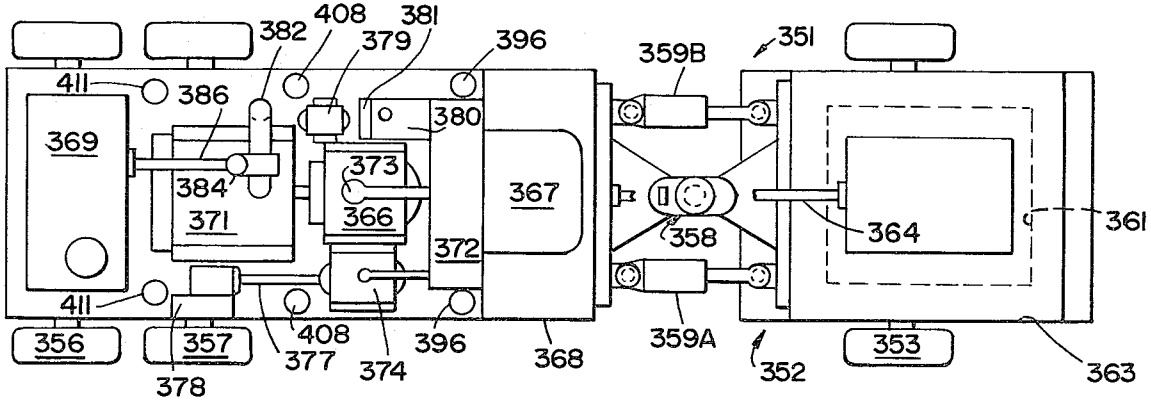
FIG. 23 is a plan view of the vehicle of FIG. 22.
Figure 22:
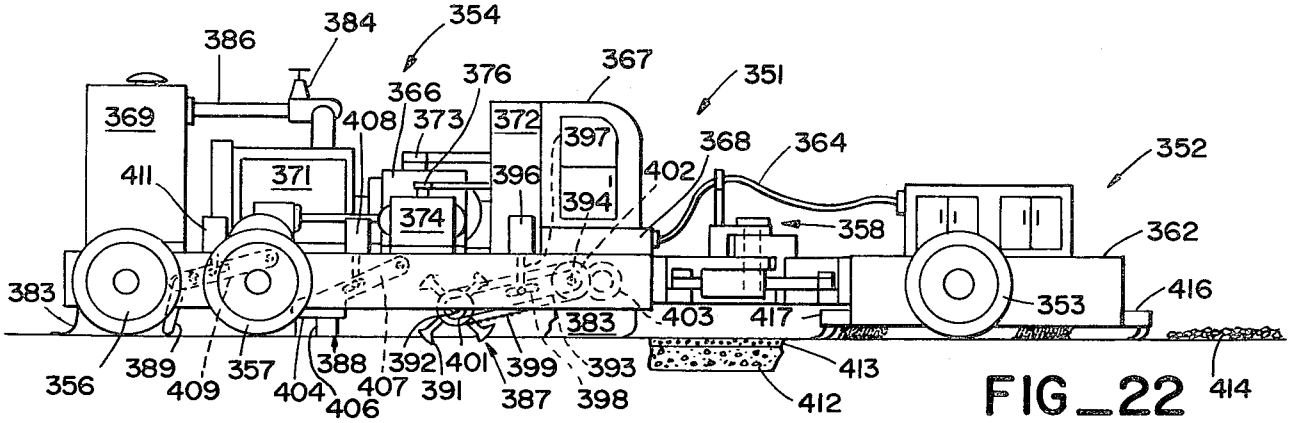
FIG. 22 is a side elevation view of a pavement surface resetting vehicle.

The vehicle depicted in FIGS. 22 and 23 is termed a surface resetting vehicle 351 since in addition to being suitable for recycling existing asphaltic pavement in the manner previously described, it is also particularly well adapted to a variation of the process which is termed resetting as distinguished from repaving. Still further, it is adapted for a variation of the process which is applicable to the maintenance of highways formed primarily of concrete.

The surface resetting vehicle 351 has a front section 352 riding on a pair of road wheels 353 and a longer rear section 354 supported at the back end by two sets of powered road wheels 356 and 357. The surface resetting vehicle 351 of this example is an articulated vehicle of the type in which the front section 352 and the rear section 354 are linked together at a high-strength pivot connection 358 situated centrally between the two vehicle sections and which enables pivoting of one vehicle section relative to the other about a vertical axis while being rigid against any pivoting movement about any orthogonal axes. As is customary in articulated vehicles of this general form, a pair of hydraulic steering cylinders 359A and 359B are coupled between the two vehicle sections with each cylinder being situated at an opposite side of the pivot connection 358 so that extension of one cylinder accompanied by contraction of the other forcibly angles the front section 352 relative to the back section 354 to enable steering of the vehicle.

The front section 352 is a microwave applicator which may have an internal construction similar to that of one of the microwave applicator vehicles hereinbefore described and which thus establishes a microwave heating and decomposing region 361 below the body 362 of the vehicle with the microwave heating region being bounded by a trapping region 363 of one of the forms hereinbefore described to prevent the escape of microwave energy from the gap between the underside of the vehicle and the pavement. Electrical power for operating the microwave applicator components at the front section 352 is received through a flexible power cable from a generator 366 carried on the rear section of the vehicle.

The rear section 354 of the surface resetting vehicle has an operator's compartment 367 carried on the forward portion of a frame 368. An insulated tank 369 for supplementary asphalt, paving oil or conditioners is carried near the back of frame 368 preferably over the rearmost supporting road wheel 356. Generator 366 is driven by an engine 371 with the generator and driving engine being situated forward from the tank 369 and with the output terminals 373 of the generator being connected to an electrical power cabinet 372 situated immediately behind the cab to contain the rectifiers, voltage regulators and the like for the microwave generators. Engine 371, which supplies all power for this example of the surface resetting vehicle 351, is preferably of the turbine form as turbine engines produce a relatively large amount of hot exhaust in comparison with piston engines and certain operations for which the resetting vehicle 351 may be utilized preferably employ relatively large amounts of hot gas as will hereinafter be discussed in more detail.

Although a separate driving engine can be provided if desired, a more compact and less costly vehicle construction may be realized by utilizing part of the power output of generator 366 as a source of motive energy for the vehicle. For this purpose, an electrical motor 374 having terminals 376 coupled to power cabinet 372 is carried on frame 368 adjacent generator 366. The output shaft 377 of motor 374 is drivingly coupled to road wheels 357 and 356 through suitable speed reduction gearing 378. Still another electrical motor 379 may be carried on the frame 368 to drive a pump 381 for pressurizing hydraulic fluid from a hydraulic tank 380 to operate the several actuators on the vehicle which will hereinafter be described.

Frame 368 defines an inverted rectangular box-like structure beneath which tilling, scarifying, grading or other operations may be performed on heated decomposed pavement as will be discussed in more detail. To provide for a supplementary heat input into the underlying pavement during such operations, ducting 382 transmits the exhaust gas of engine 371 downward to the region within frame 368. To aid in retaining hot gas around the area of such operations and to prevent the impelling of pavement constituents outwardly from under the vehicle, flexible skirts 383 extend downward to the pavement from the front, back and side edges of frame 368. A valve 384 in ducting 382 provides for the selective diversion of a portion of the exhaust gas of engine 371 to a conduit 386 which delivers such heated gas to tank 369 when this is necessary to maintain the contents of the tank in a heated condition.

In order to perform any of several further operations on pavement which has been heated and decomposed by microwave energy by the front section 352 of the vehicle, one or more pavement-working mechanisms are carried within the frame 368 and in this example include a rotary tiller 387, a rake or scarifier 388 and a grader blade 389. Rotary tiller 387, carrying cutting and mixing heads 391, may be of the form previously described and has a drive shaft 392 which is journaled in the lower ends of support arms 393 that have upper ends pivotably coupled to the sides of frame 368 through axles 394. Hydraulic actuators 396 on frame 368 may have extensible and contractable rods 397 engaged in longitudinal slots 398 on arms 393 to provide for controlled raising and lowering of the tillers relative to the underlying pavement. The tiller may be driven by a drive chain 399 linking a gear 401 on drive shaft 392 with another gear 402 disposed coaxially on axle 394 and which is driven by an electrical motor 403 secured to frame 368.

Rake 388 may include a transverse member 404 having one or more rows of linear spaced-apart tines 406, of which there are three rows in this example, extending downward from the underside in order to rake or scarify the surface of the underlying heated pavement. Member 404 may be secured to the lower ends of support arms 407 at each side of the vehicle with the upper ends of the support arms being pivotably coupled to frame 368 to enable selective raising and lowering of tines 406 by hydraulic actuators 408.

Blade 389 may be a transverse member carried within frame 368 behind rake 388 with the upper end of the drag blade being coupled to support arms 409 at each side of the vehicle that have upper ends pivoted to frame 368. A hydraulic actuator 411 is carried on frame 368 at each side of the vehicle and is coupled to the blade support arm 409 at that side to provide for selective raising and lowering of the blade 389 relative to the pavement to perform grading and smoothing operations.

The surface resetting vehicle 351 may, if desired, be utilized to perform the pavement-recycling process as hereinbefore described. The vehicle 351 may be driven along a strip of pavement at a rate at which the pavement underlying microwave application zone 361 is heated and decomposed. Tiller 387 may then be lowered to remix the decomposed pavement constituents and blade 389 may then be used to regrade the remixed pavement. The present example of the vehicle is followed by a separate compactor vehicle although it will be apparent that a screed may be mounted on vehicle 351 for this purpose as previously described with respect to another embodiment of the invention.

The vehicle 351 may also be utilized in what is termed a pavement surface resetting operation which differs from the process previously described in that decomposition by microwave heating under the application zone 361 is limited to less than the full depth of the old asphaltic pavement. Instead, only a surface layer of the old pavement, typically of the order of one or two inches or three to five centimeters in depth, is decomposed. While this decomposed surface layer of the old pavement may be remixed with tiller 387 and then graded with blade 389 and may then be recompacted, reconditioning of the surface layer of the pavement may also be accomplished in many cases simply by raking or scarifying the heated decomposed surface layer with rake 389. For this purpose, rake 389 is lowered to penetrate tines 406 the appropriate depth into the surface layer of the pavement while the vehicle is traveled along the decomposed pavement. The pavement may be repetitively raked in this manner by periodically reversing the direction of travel of surface resetting system 351 at successive areas of the pavement and, where necessary, supplemental asphalt from tank 369 may be released into the pavement prior to or between stages of raking. Subsequently the decomposed and raked or stirred surface layer of pavement may be smoothed and regraded by driving the vehicle to sweep the lower edge of blade 389 through the reworked area.

Hot exhaust gas from engine 371 is directed into the decomposed pavement constituents during the above-described raking or tilling operations through ducting 382 to reduce the amount and time of microwave heating needed. A surface heating action such as that provided by the hot exhaust gas is somewhat more efficient in a surface resetting operation of this kind than is the case where the pavement must be heated and decomposed to greater depths. For this reason and because a lesser amount of remixing may be satisfactory in a surface resetting process, the degree of microwave heating which is required may be somewhat less than in the case of full recycling of the old pavement, microwave heating to temperatures in the range from about 180° F. (80 c.) to about 200° F. (95 c.) being satisfactory in the case of a surface resetting process.

Variations of the method of the present invention may be advantageously utilized in the repair and maintenance of deteriorated concrete highways and may also be used to recover discarded asphalt from old dump sites. In particular, the practice of refurbishing deteriorated concrete highway pavement 412 by overlaying a relatively narrow layer of asphalt pavement 413 has recently come into practice to a limited extent utilizing conventional asphalt paving techniques and apparatus. This application of an overlay of asphalt pavement 413 to a concrete highway 412 or the like can be accomplished very efficiently by using the method and apparatus of the present invention but unlike the pavement recycling operations previously described, it is necessary to truck in the asphalt pavement constituents when the overlay is first applied to the concrete. While new asphalt pavement constituents may be used to initially lay down the asphalt pavement overlay 413, the method and apparatus of the present invention enables a highly efficient use of old discarded asphalt pavement chunks, recovered from a dump site, for such purposes. In particular, a layer 413 of small chunks of old asphalt pavement recovered from a dump site may be spread out in a layer 414 on the concrete pavement of the road which is to be reconditioned. The vehicle 351 of FIGS. 22 and 23 or any of the other roadpaving vehicles or systems hereinbefore described may then pass over the layer 414 to successively heat, decompose, remix and regrade the old asphalt pavement to form the desired asphaltic overlay 413 at the surface of concrete highway 412. In this particular usage at least the front and rear microwave trapping structures 416 and 417 respectively on the microwave applicator portion of the system should be of a particular one of the previously described forms that is capable of allowing passage of the loose chunks 414 under the trapping structures without substantial disturbance. Flexible skirt traps and gap traps of the previously described forms meet this requirement.

Following the initial overlay of a concrete highway 412 with a relatively thin asphalt layer 413, the surface resetting system 351 may then be periodically utilized to repeatedly recondition the road surface at intervals, as previously described, without necessarily requiring new paving materials.

Figure 25:
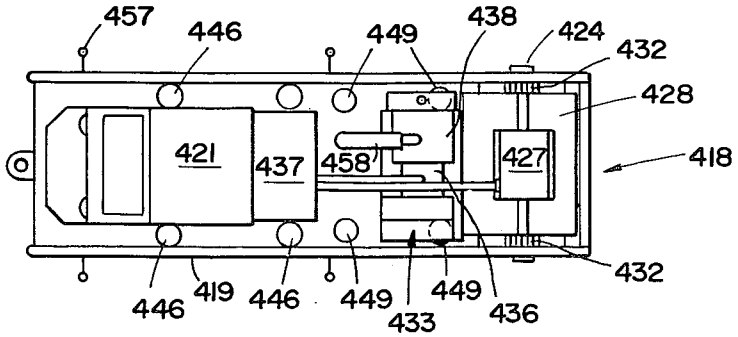
FIG. 25 is a side elevation view of the vehicle of FIG. 24.
Figure 24:
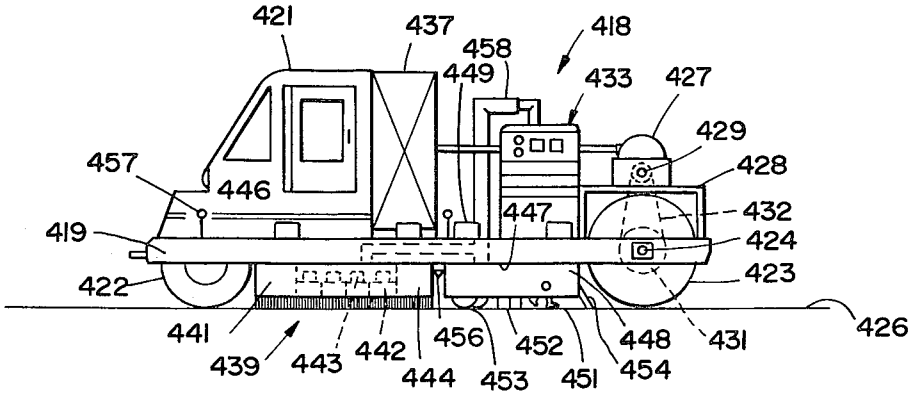
FIG. 24 is a side elevation view of an asphalt patching and resetting vehicle.

Techniques and apparatus in accordance with the invention are also applicable to the patching and repairing of scattered localized relatively small areas of deteriorated pavement under circumstances where it is not desired to repave a large continuous area of the pavement. While the previously described systems may be utilized for such purposes, relatively small jobs and the patching of small localized areas such as scattered cracks, potholes and the like can be more economically accomplished with a smaller vehicle carrying components suitable for performing certain steps of the process. FIGS. 24 and 25 in conjunction illustrate an example of such a smaller vehicle which is termed an asphalt patching and resetting vehicle 418 as it is particularly well adapted for such operations although it may also be used to repave or reset a lengthy continuous strip of pavement in the manner hereinbefore described.

Patching vehicle 418 may have a frame 419 carrying an operator's cab 421 and riding on a pair of steerable front road wheels 422 and on a compactor roller 423 which is journaled to the back end of frame 419 by a cross axle 424. To drive the vehicle in the forward and backward direction, a reversible electric motor 427 is mounted on a platform 428 above roller 423. Gears 429 at each end of the output shaft of motor 427 drive larger gears 431 disposed coaxially on each end of roller axle 424 through a pair of drive chains 432 which couple each gear 429 with the gear 431 at the same side of the vehicle.

To provide power for the several electrical components of the vehicle 418, a motor generator set 433 including a generator 436 and driving engine 438 is carried above frame 419 and an electrical power supply and control cabinet 437 is carried behind cab 421. The engine 438 of the motor generator set is a diesel engine 438 or other suitable fuel-burning engine of the form which produces hot exhaust.

A microwave applicator unit 439, contained within an inverted rectangular boxlike housing 441 formed of electrically conductive material, is disposed at the underside of the forward portion of the vehicle to heat and decompose asphalt pavement at localized areas which are to be repaired. Applicator section 439 may have internal elements similar to that of the corresponding components of the applicator vehicles hereinbefore described and may, for example, thus include transversely disposed lossy waveguides 442 each energized by a magnetron tube 443 or other suitable microwave generator. Trapping regions 444 are situated around the periphery of the region of waveguides 443 to block the release of microwave energy at the gap between the lower edge of housing 441 and the underlying pavement 426 and may be of any of the forms hereinbefore described. Preferably the microwave applicator unit housing 441, in which the waveguides 443 and other internal components are disposed, is suspended from frame 419 by actuators 446 for selectively raising and lowering the housing 441. In addition to provide for adjustment of the gap between the microwave applicator unit and the underlying pavement, this enables vertical retraction of the housing 441 and internal components when the vehicle is to be traveled along the road of the like between areas which require patching.

Also disposed at the underside of frame 419, between the microwave applicator section 439 and roller 423, is a pavement reworking section 447. Reworking section 447 may again be formed of an inverted rectangular boxlike body 448 again preferably suspended from frame 419 through actuators 449 which enable raising and lowering of the section both to adjust reworking depth in the pavement and to enable vertical retraction of the section when the vehicle is to be traveled between work areas. Reworking section body 448 may contain any of the several remixing components hereinbefore described in connection with other embodiments of the invention and in this example includes a rotary tiller 451 and a scarifier or rake having rows of tines 452. It should be understood that the pavement reworking implements useful in the present invention are not limited to the tillers and rakes heretofore described for purposes of example but may include other components which provide for cutting, stirring, mixing and the like of decomposed pavement. For example, rows of plowing discs 453 of the form heretofore used for agricultural operations, may also be carried in the reworking section 447. To enable regrading, a final element carried at the back of the reworking section 447 is a grader blade 454.

A pavement temperature sensor probe 456 is carried below frame 419 between the microwave applicator section 439 and the reworking section 447 to enable the operator to determine when an area of pavement to be patched has been heated to the desired temperature. Similarly, microwave energy detectors 457 of suitable known forms may be mounted on frame 419 preferably above the four corners of the microwave applicator section 439 to detect any escape of microwave energy. In order to make most efficient use of the energy content of the fuel consumed by the vehicle engine 438 as well as to enhance the microwave heating operation and pavement reworking operations, ducting 458 may again be provided to transmit the hot exhaust gas from the engine to the pavement reworking section 447 and also to the microwave heating region below microwave applicator section 439.

In operation for such purposes as patching small localized deteriorated areas in pavement 426, such as potholes or cracks, the vehicle 418 is initially driven to a position where the microwave applicator section 439 is situated over the area to be reworked and the pavement within and immediately surrounding the deteriorated area is then heated and decomposed. The vehicle is then traveled forwardly and, if necessary, is traveled in repetitive forward and backward motions to enable the remixing or scarifying mechanisms within the reworking section 447 to remix or stir the decomposed pavement area. Thereafter the vehicle is traveled forwardly to regrade the reconditioned area with grader blade 454 and then to compact the regraded area with roller 423.

In addition to facilitating the repair of small isolated deteriorated portions of the pavement 426 as described above, the patching vehicle 418 is also highly suited to recycling of the asphaltic pavement which often forms a narrow shoulder strip along highways that are primarily formed of concrete. For such an operation the vehicle 418 may simply be traveled slowly and continuously along the asphalt shoulder to perform in sequence the several necessary operations as previously described with reference to larger vehicle systems.

Figure 27:
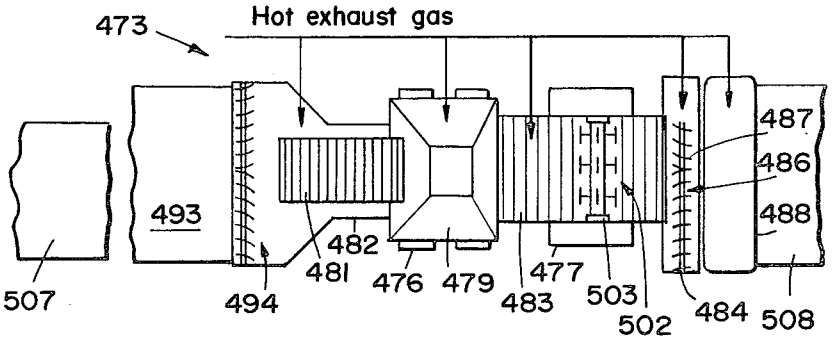
FIG. 27 is a plan view of the system of FIG. 26.
Figure 26:
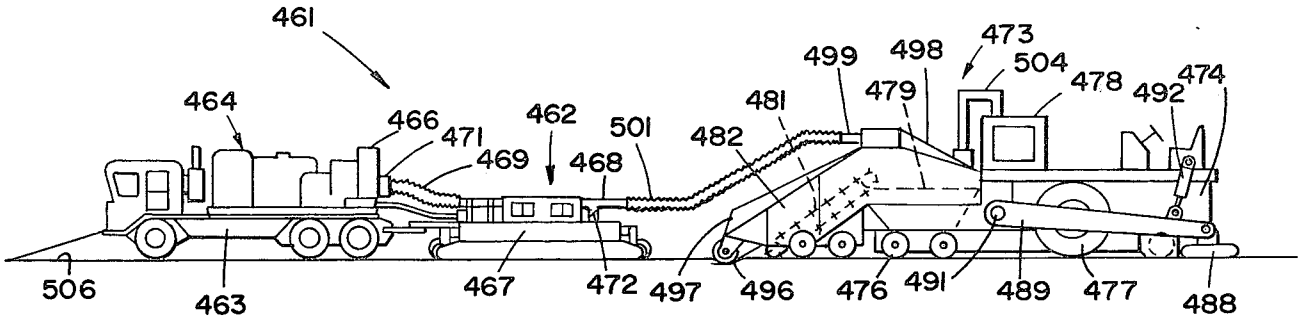
FIG. 26 is a side elevation view of still another large road repaving system.

Referring now to FIGS. 26 and 27, the invention may be practiced on a large scale in a highly efficient manner without necessarily requiring use of the complex specialized vehicles previously described. FIGS. 26 and 27 illustrate still another large road repaving system 461 which, aside from a component microwave applicator vehicle 462 of the specialized form hereinbefore described, is composed of components which, taken individually, are known commercially available devices having only some easily accomplished structural modifications.

The propulsion unit of the system 461 may again be a large flat-bed self-powered truck 463 carrying a pair of motor generator sets 464 with the exhaust gases of the diesel engines or the like which drive the generators being collected in a gas housing 466 also carried on the truck, the propulsion unit being similar to that previously described with respect to other embodiments of the invention. Similarly the microwave applicator section 462 may be a microwave applicator vehicle 467 of any of the previously described forms that is towed by truck 463. As in certain of the previously described embodiments, applicator vehicle 467 has an insulated hot gas conduit 468 receiving hot gas from housing 466 of the truck through a flexible, expandable and contractable bellows conduit 469 that connects with a blower 471 on the truck and draws gas from housing 466. Applicator vehicle 467 preferably includes a valve 472 through which an adjustable gas flow from conduit 468 may be directed to the microwave heating region. Although a single such microwave applicator vehicle 467 is utilized in this example of the system 461, additional microwave applicator vehicle may be connected into the system in tandem if desired.

Unlike the previously described embodiments, the remixing, grading and recompacting steps in the system 461 are performed by a paving machine or paver 473 most portions of which may be of conventional construction.

Salient elements of a paver 473 include a body 474 riding on support wheels 476 and on large drive wheels 477. An engine 478 carried on body 474 powers the vehicle. A paver also typically includes a hopper 479 for receiving hot mix. An endless belt conveyor 481 extends forwardly and downwardly from the front of the hopper, within a receiving chute 482, to pick up asphaltic hot mix and to lift and convey the mix into the top of hopper 479.

In the conventional usage of a paver, asphaltic hot mix is trucked to the work site and deposited in a windrow in front of the path of the paver where it is picked up by the conveyor 481 and deposited in hopper 479. The paver has another endless belt conveyor 483 which carries the hot mix from the lower end of hopper 479 backwardly to the rear portion of the vehicle where it is discharged onto a transversely disposed trough 484. A layer of the hot mix is then deposited on the roadbed from the trough. Where, as in this example, the extent of the trough 484 is greater than the width of the conveyer 483, a powered screw or auger type of conveyor 486 may be disposed transversely of the vehicle in trough 484 to carry a portion of the material in the conveyor sidewardly from the belt conveyor 453 so that it is deposited in a uniform layer across the roadbed. For this purpose the auger elements 487 of conveyor 486 spiral in opposite senses at each side of the center line of the vehicle.

To grade and compact the deposited mix, a screed 488 is disposed transversely beneath the back end of the paver 473 to ride against and compress the freshly deposited layer. Screed 488 may be pivotally coupled to one of a pair of drag arms 489 at each side of the vehicle and the drag arms extend forwardly and upwardly from the screed and are coupled to the body of the vehicle at the forward ends by pivot means 491. One of a pair of hydraulic cylinders 492 is connected between the back portion of each drag arm 489 and the body of the vehicle to provide for a controlled adjustment of the vertical level of the screed 488.

Considering now certain modifications which are preferably made to the paver 473 to enable it to function as a component of the repaving system 461 in the most efficient manner, the chute 482 at the forward end of the paver which receives hot mix is preferably formed to be sufficiently broad at the forward end to intercept the entire width of the strip of pavement 493 which is to be recycled. Where this requires a chute having sizably greater width than the associated conveyor 481, the transport of intercepted decomposed old pavement onto the conveyor and up into hopper 479 may be facilitated by disposing another powered screw-type conveyor 494 immediately above the forward edge 496 of the chute which edge is shaped to form a scoop for picking up the decomposed old pavement. Screw conveyor 494 may be similar to the previously described rear conveyor 486 except insofar as the auger elements spiral in a reversed direction in order to draw intercepted material towards the center line of the paver rather than to carry it outward towards the sides as in the case of the rear conveyor.

Another readily accomplished modification of the paver 473 which facilitates the present method, is to dispose a cover 497, preferably formed of thermally insulated material, across the top of receiving chute 482 and to dispose an essentially similar cover 498 above hopper 479. By this means hot exhaust gases may be retained around the path of the decomposed pavement mix as it passes through the paver. To receive the hot exhaust gas, an inlet fitting 499 may be provided at the top of cover 498 and another section 501 of flexible pleated gas conduit connects the fitting 499 with the back end of the gas conduit 468 of the microwave applicator vehicle 467.

As many conventional pavers are designed to pick up premixed pavement constituents, mixing mechanisms may not be provided on such vehicles. In the system of FIGS. 26 and 27, a considerable amount of mixing of the intercepted decomposed old pavement occurs inherently through the actions of the several mechanisms described above. A mixing effect occurs initially at the forward screw conveyor 494 and to some extent through the action of the initial conveyor 481 and in the course of the dropping of the material into the hopper 479. Further mixing action occurs at the rear screw conveyor 484. In instances where the paver construction does not otherwise provide a sufficient degree of remixing, one or more powered rotary tiller mechanisms 502 of the previously described form may readily be installed in the paver, for example immediately above the rear conveyor 483. As pressurized hydraulic fluid is usually already present on a paver for the purpose of operating various hydraulic cylinders, a rotary fluid motor 503 may be used to drive the tiller mechanism 502 although other forms of drive motor may also be employed.

As indicated in FIG. 27 in particular, the above-described construction establishes a beneficial direction of hot exhaust gas into the decomposed pavement mix within the paver and against various components which come in contact with the mix. From fitting 499, hot gas flows between chute 482 and conveyor 481, into hopper 479, above conveyor 483 including through the mixing region at tiller 502, and to trough 484 and screed 488. Referring to FIG. 26 in particular, if the hot gas flow produced by the motor generator sets 464 should not be adequate to meet the demand for both the microwave applicator vehicle 467 and the paver 473, the hot gas flow may be supplemented by providing ducting 504 to also transmit the exhaust from paver engine 478 down into the region below cover 479.

In other instances, the gas conduit connection 501 between the paver 473 and the microwave applicator vehicle 467 may be eliminated and the exhaust gas of paver engine 478 may then be relied on, through ducting 504, to supply the needs of the paver. It is of interest in this connection that in conventional paver constructions, a butane burner or the like is often provided to maintain the contents of hopper 479 in a heated condition. It has apparently heretofore escaped notice that the paver engine 478 in these prior constructions may be discharging and wasting around 70% of the energy content of consumed fuel in the form of exhaust gas having temperatures of several hundred degrees Fahrenheit or Celsius.

In operation, the system 473 is traveled slowly down a deteriorated road 506 which is to be repaved. The old pavement is rapidly heated and decomposed below the microwave applicator vehicle 467 in the manner previously described. The decomposed pavement is subsequently intercepted by scoop 496 of the paver 473, carried towards the center of the paver by screw conveyor 494 and then channeled upwardly and backwardly into hopper 479 by chute 482 and conveyor 481 in conjunction. The recovered and heated pavement mix is then carried rearwardly from below hopper 479 by conveyor 483, undergoes further mixing by tiller mechanism 503 and is then redeposited on the roadbed in the form of a layer of hot remix which is then graded and recompacted by screed 488 to leave behind a repaved, recycled road surface. Little or no new asphalt is needed. Materials need not be trucked back and forth between a distant mixing plant or dump site and a much more efficient usage of consumed fuels is realized than has heretofore been the case in paving operations.

The system of FIGS. 26 and 27 lends itself readily to still another highly advantageous variation of the process. Specifically, it may be desired to widen an existing road. In many cases, due to past resurfacing or overlaying operations or other causes, the depth of pavement on the existing road may be deeper than is actually needed. Where that is not the case, a relatively small amount of new paving mix may be brought in and deposited on the old roadbed in front of the system 473.

If the rear screw conveyor 484 and screed 488 of the paver are then selected to have dimensions capable of spanning the desired widened surface, then it may be seen that the above-described system acts to provide the desired wider road by utilizing at least in part the materials of the older, narrower road. Thus as indicated diagrammatically in FIG. 27, the system 473 may be traveled down an old, narrow roadway 507 leaving behind the widened repaved road surface 508.

The invention was initially developed primarily for use at pavements which are asphaltic or where asphalt is overlaid on concrete. Certain aspects of the invention are also useful with non-asphaltic pavements. For example, it has been pointed out that microwave energy enables a very rapid and efficient heating of concrete. Certain known concrete maintenance operations require the on-site heating of the pavement to dry the concrete and in some cases to aid polymerization or other setting processes of sealants or the like which are applied to the pavement. Heretofore such heating has required long periods of time as it has been necessary to rely on the slow conduction of heat downward from the surface of the concrete which material inherently has a low coefficient of thermal conductivity. The microwave applicator devices hereinbefore described are a much more efficient and rapid concrete heating system for such purposes. In such usages of the microwave applicators, the remixing components, compaction mechanisms and the like of the previously described road repairing systems are not necessarily required.

While the invention has been described with respect to specific embodiments, it will be apparent that many modifications are possible and it is not intended to limit the invention except as defined in the following claims.

What is claimed is:

1. A method for recycling existing asphalt pavement comprising the steps of:

establishing a microwave energy containment region above said pavement including positioning microwave energy emitting waveguide means in spaced apart relationship from said pavement to provide a gap enabling traveling of said waveguide means without direct contact with said pavement, traveling said containment region along said existing asphalt pavement while concurrently generating heat within the interior of said pavement, to soften the asphalt content thereof, by directing microwave energy into said pavement from said containment region while traveling therealong, including distributing said microwave energy substantially uniformly across the width of a strip of said pavement over which said containment region is traveled, suppressing outward propagation of microwave energy from said containment region through said gap while traveling along said pavement, subsequently remixing the constituents of said pavement while said pavement is in the softened state, and recompacting the remixed pavement constituents substantially at the original location thereof to provide renewed pavement thereat.

2. The method of claim 1 wherein said microwave energy propagates outwardly from said containment region within said gap and wherein said step of suppressing outward propagation of microwave energy from said containment region is accomplished at least in part by reflecting the upwardly directed component of said outwardly propagating microwave energy down into said pavement for absorption therein and thereby causing a progressive attenuation of microwave energy intensity in the outward direction within said gap.

3. A method for recycling existing asphalt pavement as set forth in claim 1 including the further steps of producing said microwave energy by operating a microwave source with electrical power from a generator driven by a fuel-consuming engine, and directing at least a portion of the hot exhaust of said engine to said pavement to supplement the microwave heating thereof.

4. The method of claim 3 wherein said hot exhaust is directed at said pavement in the same area thereof that receives said microwave energy.

5. The method of claim 3 wherein said hot exhaust is directed at said pavement constituents during said remixing thereof.

6. The method of claim 1 wherein said step of establishing a microwave energy containment region above said pavement is accomplished by disposing electrically conductive material above said region and around the sides thereof and by releasing said microwave energy into the region bounded by said conductive material and the underlying portion of said pavement while traveling said region including said conductive material along said pavement.

7. The method of claim 1 wherein said decomposing of said existing pavement by microwave energy and said remixing of the constituents thereof is confined to a surface layer of said existing pavement.

8. The method of claim 1 wherein said existing asphalt pavement is a layer of asphalt pavement overlaid on concrete pavement.

9. A method of reconditioning nonasphaltic concrete pavement comprising the steps of:

depositing a layer of asphaltic pavement constituents on said nonasphaltic concrete pavement, establishing a microwave energy containment region above said layer including positioning microwave energy emitting waveguide means in spaced apart relationship from said pavement to provide a gap enabling traveling of said waveguide means without direct contact with said layer, traveling said containment region along said pavement while concurrently generating heat within the interior of said layer by directing microwave energy into said layer from said containment region while traveling therealong, including distributing said microwave energy substantially uniformly across the width of said layer over which said containment region is traveled, suppressing outward propagation of microwave energy from said containment region, and through said gap while traveling along said layer, compacting said layer of asphaltic pavement constituents against said concrete pavement while in the heated state.

10. The method of claim 9 further comprising the steps of recovering old asphalt pavement chunks from another site, depositing said pavement chunks over said non-asphaltic concrete, and utilizing said recovered old asphaltic pavement chunks to form said layer of asphaltic pavement constituents on said concrete pavement.

11. Apparatus for heating pavement in place at a paved surface while traveling therealong comprising:

a vehicle with support means for enabling travel along said pavement, microwave applicator means supported on said vehicle for travel along said pavement therewith while applying microwave energy thereto, said applicator means including a microwave containment structure having an electrically conductive top portion spaced above the underlying surface along which said vehicle travels and having electrically conductive side portions extending from said top portion downward toward said underlying surface to define the upper portion of a traveling microwave region which is bounded by said top portion and said side portions and the underlying area of pavement and by a gap between said side portions and said underlying pavement, said applicator means further including a plurality of waveguides positioned to distribute microwave energy substantially uniformly across said underlying area of said pavement and to generate heat within said pavement substantially uniformly thereacross as said vehicle travels along said pavement, means carried on said vehicle for releasing microwave energy into said microwave region through said plurality of waveguides to heat said pavement within said underlying area thereof while traveling along said pavement, and microwave energy-trapping means for suppressing the release of microwave energy through said gap as said vehicle travels along said pavement, said microwave energy-trapping means being disposed on said vehicle adjacent to said gap in position to receive microwave energy which would escape from said microwave region through said gap beneath said containment structure in the absence of said trapping means.

12. Apparatus for heating pavement in place at a paved surface as set forth in claim 11 further comprising:

at least one microwave source carried on said vehicle, at least one electrical generator coupled to said microwave source to supply electrical power thereto, at least one fuel-consuming engine mechanically coupled to said generator to drive said generator, and means carried on said vehicle for directing at least a portion of the hot exhaust of said engine to said pavement to supplement the heating effects of said microwave energy.

13. Apparatus for heating pavement in place at a paved surface as set forth in claim 11 wherein said means carried on said vehicle for releasing microwave energy into said microwave region includes at least one microwave source carried on said vehicle, and at least one electrical generator coupled to said microwave source to supply electrical power thereto, and at least one fuel-consuming engine mechanically coupled to said generator to drive said generator, and at least one receptacle supported on said vehicle for carrying a supply of fresh supplemental pavement constituent, means for selectively delivering said supplemental constituent to said pavement as said vehicle travels therealong, and means connected between said engine and said receptacle for directing at least a portion of the heat from the exhaust of said engine to said receptacle to maintain said supplementary constituent in a heated condition.

14. Apparatus for heating pavement in place at a paved surface as set forth in claim 11 further comprising:

means carried on said vehicle for remixing the constituents of said pavement following passage of said microwave enclosure thereover, a fuel-consuming engine disposed on said vehicle, a generator disposed on said vehicle and being mechanically coupled to said engine and driven thereby and being electrically coupled to said microwave source means to energize said source means, and means carried on said vehicle for directing at least a portion of the hot exhaust of said engine at said pavement constituents during said remixing thereof.

15. The apparatus of claim 14 further comprising a first actuator for selectively raising and lowering said microwave enclosure, and a second actuator for selectively raising and lowering said remixing means.

16. The apparatus of claim 11 wherein said microwave energy-trapping means comprises electrically conductive members carried on said vehicle above said pavement in spaced-apart relationship therefrom and extending outwardly from said microwave containment structure in position to reflect the upwardly directed component of microwave energy, that propagates through said gap, downwardly into said underlying surface.

17. The apparatus of claim 11 wherein said microwave energy-trapping means comprises flexible electrically conductive elements disposed on said vehicle and extending downwardly to said underlying surface at said gap beneath said microwave containment structure in position to reflect microwave energy, that propagates into said gap, back towards said traveling microwave region.

18. The apparatus of claim 11 wherein said microwave energy-trapping means comprises a front microwave trap extending transversely across the front of said microwave region at said gap, a rear microwave trap extending transversely across the back of said microwave region at said gap and a pair of side microwave traps extending along a separate side of said microwave region at said gap, at least one of said side microwave traps being vertically movable relative to said microwave containment structure.

19. The apparatus of claim 18 further comprising a plurality of ground-engaging wheels journaled to said one side trap to maintain said one side trap at a predetermined elevational level relative to the underlying surface.

20. The apparatus of claim 11 wherein said microwave energy-trapping means is a gap trap comprising a plate of electrically conductive material extending outwardly from said microwave enclosure above said gap and having at least an underside which is spaced above said underlying surface in at least substantially parallel relationship thereto.

21. Apparatus for heating pavement in place at a paved surface while traveling therealong as set forth in claim 11 wherein said microwave energy-trapping means comprises a plural layered mass of individually flexible electrically conductive elements attached to said microwave containment structure and extending downward to drag along said underlying surface.

22. Apparatus for heating pavement in place at a paved surface while traveling therealong as set forth in claim 11 wherein said microwave energy-trapping means includes a skirt trap comprising a linear strip of electrically conductive material extending along a boundary of said microwave region at said gap, said strip having an upper edge fastened to said microwave applicator means and having a lower portion which extends downward to contact said underlying surface, and wherein said strip is formed of flexible material and is proportioned to extend downward to said underlying surface and to bend thereat enabling the lowermost portion to lie against said underlying surface and drag therealong.

23. Apparatus for heating pavement in place at a paved surface while traveling therealong as set forth in claim 11 wherein said microwave energy-trapping means includes a skirt trap comprising a linear strip of electrically conductive material extending along a boundary of said microwave region at said gap, said strip having an upper edge fastened to said microwave applicator means and having a lower portion which extends downward to contact said underlying surface, and wherein said strip is formed of substantially rigid material and wherein said lower portion of said strip extends downward a distance greater than the height of said gap enabling the lower edge of said strip to penetrate into said underlying surface.

24. The apparatus of claim 11 wherein each of said plurality of waveguides of said microwave applicator means is supported on said vehicle at said microwave region in spaced apart relationship from said underlying surface along which said vehicle travels and has at least one opening for transmitting microwave energy towards said underlying surface from a zone extending along the side of the waveguide, and said means for releasing microwave energy into said region comprises microwave energy-generating source means coupled to each of said waveguides for energizing said waveguides.

25. The apparatus of claim 24 having a plurality of said waveguides disposed in parallel relationship and having a plurality of said microwave-generating sources each coupled to a separate one of said waveguides.

26. Apparatus for heating pavement in place at a paved surface comprising:

a vehicle with support means for enabling travel along said pavement, a microwave enclosure supported on said vehicle and formed of electrically conductive material, said microwave enclosure having a top portion spaced above the underlying surface along which said vehicle travels and having side portions extending from said top portion downward toward said underlying surface to define a microwave region bounded by said top portion and said side portions and the underlying area of pavement, microwave source means carried on said vehicle for releasing microwave energy into said microwave region to heat said pavement within said underlying area thereof, microwave energy-trapping means secured to said vehicle for suppressing the release of microwave energy from said region, means carried on said vehicle for remixing the constituents of said pavement following passage of said microwave enclosure thereover, wherein said vehicle is self-propelled and multiply articulated and has a microwave applicator section carrying said microwave enclosure and said microwave source means and said trapping means and further has a remixing section carrying said remixing means, said microwave applicator section and said remixing section being coupled together by a first pivot means, the vehicle further including a propulsion section situated forward from said microwave applicator section and coupled thereto by second pivot means, an engine and a generator driven thereby each being disposed on said propulsion section of said vehicle, electrical power conduction means extending from said generator to said microwave applicator section and being flexible at least in the region of said second pivot means, and a gas duct extending from said propulsion section to said microwave applicator section and to said remixing section and having means for transmitting hot exhaust from said engine to the pavement underlying said microwave applicator section and to the pavement underlying said remixing section, said gas duct being flexible at least in the region of said first and second pivot means.

27. Apparatus for heating pavement in place at a paved surface while traveling therealong comprising:

a vehicle with support means for enabling travel along said pavement, microwave applicator means supported on said vehicle for travel along said pavement therewith while applying microwave energy thereto, said applicator means having an electrically conductive top portion spaced above the underlying surface along which said vehicle travels and having electrically conductive side portions extending from said top portion downward toward said underlying surface to define the upper portion of a traveling microwave region which is bounded by said top portion and said side portions and the underlying area of pavement and by a gap between said side portions and said underlying pavement, said applicator means including a plurality of waveguides for distributing and dispersing microwave energy across said underlying area of said pavement to heat said pavement substantially uniformly thereacross as said vehicle travels along said pavement, means carried on said vehicle for releasing microwave energy into said microwave region through said plurality of waveguides to heat said pavement within said underlying area thereof while traveling along said pavement, microwave energy-trapping means for suppressing the release of microwave energy through said gap as said vehicle travels along said pavement, said microwave energy-trapping means being carried on said vehicle in position to receive microwave energy which would escape from said microwave region through said gap in the absence of said trapping means, wherein said microwave energy-trapping means includes a front microwave trap extending transversely across the front of said microwave region at said gap, a rear microwave trap extending transversely across the back of said microwave region at said gap and a pair of side microwave traps extending along a separate side of said microwave region at said gap, at least one of said side microwave traps being vertically movable relative to said microwave enclosure, and actuator means on said vehicle for selectively raising and lowering said one side trap relative to said microwave enclosure.

28. Apparatus for heating pavement in place at a paved surface while traveling therealong comprising:

a vehicle with support means for enabling travel along said pavement, microwave applicator means supported on said vehicle for travel along said pavement therewith, said applicator means having an electrically conductive top portion spaced above the underlying surface along which said vehicle travels and having electrically conductive side portions extending from said top portion downward toward said underlying surface to define the upper portion of a traveling microwave region which is bounded by said top portion and said side portions and the underlying area of pavement and by a gap between said portions and said underlying pavement, means carried on said vehicle for releasing microwave energy into said microwave region to heat said pavement within said underlying area thereof, and microwave energy-trapping means for suppressing the release of microwave energy through said gap as said vehicle travels along said pavement, wherein said microwave energy-trapping means is a gap trap comprising a plate of electrically conductive material extending outwardly from said microwave region above said gap and having at least an underside which is spaced above said underlying surface in at least substantially parallel relationship thereto, and wherein said electrically conductive plate is coupled to said microwave applicator means by means for enabling vertical movement of said plate independently of vertical movement of said microwave applicator means and further comprising a plurality of circular rotatable plate-supporting elements journaled on said plate and extending downward to said underlying surface to support said plate at a predetermined height above said underlying surface as said apparatus is traveled therealong.

29. Apparatus for heating pavement in place at a paved surface while traveling therealong comprising:

a vehicle with support means for enabling travel along said pavement, microwave applicator means supported on said vehicle for travel along said pavement therewith, said applicator means having an electrically conductive top portion spaced above the underlying surface along which said vehicle travels and having electrically conductive side portions extending from said top portion downward toward said underlying surface to define the upper portion of a traveling microwave region which is bounded by said top portion and said side portions and the underlying area of pavement and by a gap between said portions and said underlying pavement, means for releasing microwave energy into said microwave region to heat said pavement within said underlying area thereof, and microwave energy-trapping means for suppressing the release of microwave energy through said gap as said vehicle travels along said pavement, wherein said microwave energy-trapping means is a gap trap comprising a plate of electrically conductive material extending outwardly from said microwave enclosure above said gap and having at least an underside which is spaced above said underlying surface in at least substantially parallel relationship thereto, and wherein said electrically conductive plate is coupled to said microwave enclosure by means for enabling vertical movement of said plate independently of vertical movement of said microwave enclosure and further including a plurality of circular rotatable plate-supporting elements journaled on said plate and extending downward to said underlying surface to support said plate at a predetermined height above said underlying surface as said apparatus is traveled therealong, wherein each of said rotatable plate-supporting elements is journaled to said plate by resilient means for enabling limited independent vertical movement of each of said plate-supporting elements relative to said plate.

30. Apparatus for heating pavement in place at a paved surface while traveling therealong comprising:

a vehicle with support means for enabling travel along said pavement, microwave applicator means supported on said vehicle for travel along said pavement therewith, said applicator means having an electrically conductive top portion spaced above the underlying surface along which said vehicle travels and having electrically conductive side portions extending from said top portion downward toward said underlying surface to define the upper portion of a traveling microwave region which is bounded by said top portion and said side portions and the underlying area of pavement and by a gap between said portions and said underlying pavement, means for releasing microwave energy into said microwave region to heat said pavement within said underlying area thereof, and microwave energy-trapping means for suppressing the release of microwave energy through said gap as said vehicle travels along said pavement, wherein said microwave energy-trapping means is a gap trap comprising a plate of electrically conductive material extending outwardly from said microwave enclosure above said gap and having at least an underside which is spaced above said underlying surface in at least substantially parallel relationship thereto, and wherein said electrically conductive plate is coupled to said microwave enclosure by means for enabling vertical movement of said plate independently of vertical movement of said microwave enclosure and further including a plurality of circular rotatable plate-supporting elements journaled on said plate and extending downward to said underlying surface to support said plate at a predetermined height above said underlying surface as said apparatus is traveled therealong, wherein said rotatable plate-supporting elements are formed at least in part of electrically conductive material and are mutually spaced apart by distances which limit passageways between said elements to less than cutoff dimensions for the frequency of said microwave energy.

31. Apparatus for heating pavement in place at a paved surface while traveling therealong comprising:

a vehicle with support means for enabling travel along said pavement, microwave applicator means supported on said vehicle for travel along said pavement therewith while applying microwave energy thereto, said applicator means having an electrically conductive top portion spaced above the underlying surface along which said vehicle travels and having electrically conductive side portions extending from said top portion downward toward said underlying surface to define the upper portion of a traveling microwave region which is bounded by said top portion and said side portions and the underlying area of pavement and by a gap between said side portions and said underlying pavement, means carried on said vehicle for releasing microwave energy into said microwave region to heat said pavement within said underlying area thereof while traveling along said pavement, and microwave energy-trapping means for suppressing the release of microwave energy through said gap as said vehicle travels along said pavement, said microwave energy-trapping means being carried on said vehicle in position to receive microwave energy which would escape from said microwave region through said gap in the absence of said trapping means, wherein said microwave energy-trapping means includes a cavity trap comprising an inverted boxlike structure formed of electrically conductive material and extending along a boundary of said microwave region, the lower edges of said inverted boxlike structure being spaced above said underlying surface.

32. The apparatus of claim 31 further comprising a volume of electrically lossy material disposed within said inverted boxlike structure.

33. Apparatus for heating pavement in place at a paved surface while traveling therealong comprising:

a vehicle with support means for enabling travel along said pavement, microwave applicator means supported on said vehicle for travel along said pavement therewith, said applicator means having an electrically conductive top portion spaced above the underlying surface along which said vehicle travels and having electrically conductive side portions extending from said top portion downward toward said underlying surface to define the upper portion of a traveling microwave region which is bounded by said top portion and said side portions and the underlying area of pavement and by a gap between said side portions and said underlying pavement, means for releasing microwave energy into said microwave region to heat said pavement within said underlying area thereof, and microwave energy-trapping means for suppressing the release of microwave energy through said gap as said vehicle travels along said pavement, wherein said microwave energy-trapping means includes a cavity trap comprising an inverted boxlike structure formed of electrically conductive material and extending along a boundary of said microwave region, the lower edges of said inverted boxlike structure being spaced above said underlying surface, and a volume of electrically lossy material disposed within said inverted boxlike structure, and wherein said volume of electrically lossy material comprises at least one road wheel of said vehicle, said road wheel being formed at least in part of electrically lossy material and being situated within said cavity trap and constituting an element of said support means for enabling travel of said vehicle along said pavement.

34. Apparatus for heating pavement in place at a paved surface while traveling therealong comprising:

a vehicle with support means for enabling travel along said pavement, microwave applicator means supported on said vehicle for travel along said pavement therewith while applying microwave energy thereto, said applicator means having an electrically conductive top portion spaced above the underlying surface along which said vehicle travels and having electrically conductive side portions extending from said top portion downward toward said underlying surface to define the upper portion of a traveling microwave region which is bounded by said top portion and said side portions and the underlying area of pavement and by a gap between said side portions and said underlying pavement, said applicator means including a plurality of waveguides for distributing and dispersing microwave energy across said underlying area of said pavement to heat said pavement substantially uniformly thereacross as said vehicle travels along said pavement, wherein each of said plurality of waveguides of said microwave applicator means is supported on said vehicle at said microwave region in spaced apart relationship from said underlying surface along which said vehicle travels and has at least one opening for transmitting microwave energy towards said underlying surface from a zone extending along the side of the waveguide, said waveguides being disposed in parallel relationship, means carried on said vehicle for releasing microwave energy into said microwave region through said plurality of waveguides to heat said pavement within said underlying area thereof while traveling along said pavement, including a plurality of microwave energy-generating sources each coupled to a separate one of said waveguides for energizing said waveguides, further including a plurality of parallel panels of electrically conductive material each being situated between a separate adjacent pair of said waveguides in parallel relationship therewith and each extending downward from the region of said waveguides towards said underlying surface, and microwave energy-trapping means for suppressing the release of microwave energy through said gap as said vehicle travels along said pavement, said microwave energy-trapping means being carried on said vehicle in position to receive microwave energy which would escape from said microwave region through said gap in the absence of said trapping means.

35. An asphalt pavement-recycling apparatus comprising:

a self-propelled towing vehicle, at least one electrical generator carried on said towing vehicle, at least one fuel-consuming engine carried on said towing vehicle and coupled to said generator to drive said generator, at least one microwave energy applicator vehicle coupled to said towing vehicle for travel along said pavement behind said towing vehicle, said microwave applicator vehicle having a microwave energy source receiving electrical power from said generator and further having microwave energy emitting means for directing microwave energy from said source downwardly into the pavement underlying said microwave applicator vehicle said emitting means being spaced above said underlying pavement to enable travel of said apparatus along said pavement while microwave energy is being directed thereto, and microwave energy-trapping means on said applicator vehicle for suppressing the outward propagation of microwave energy from said applicator vehicle while traveling along said pavement, at least one remixing vehicle coupled to said applicator vehicle and towed thereby, said remixing vehicle carrying at least one means for remixing heated pavement over which said remixing vehicle travels, and a flexible cover extending between said microwave applicator vehicle and said remixing vehicle above said pavement.

36. A pavement-reconditioning vehicle comprising:

a front vehicle body riding on at least a pair of front road wheels and a second vehicle body riding on at least a pair of second road wheels, said front vehicle body and second vehicle body being coupled together by pivot means which enable pivoting movement of said front vehicle body relative to said second vehicle body about a vertical axis, microwave energy-generating means disposed on one of said vehicle bodies, microwave energy-emitting means carried on said front vehicle body for directing said microwave energy downwardly into pavement underlying said front vehicle body within a predetermined microwave region at the underside of said front vehicle body, said emitting means being spaced above said pavement to enable travel of said vehicle along said pavement while microwave energy is being directed thereto, microwave energy-trapping means disposed on said front vehicle body adjacent said microwave region for suppressing outward propagation of microwave energy therefrom as said vehicle travels along said pavement, remixing means carried on said second vehicle body for remixing heated pavement underlying said second vehicle body, an electrical generator carried on said second vehicle body, a fuel-consuming engine carried on said second vehicle body and being coupled to said generator to drive said generator, electrical conductor means coupling said generator to said microwave energy-generating means, an electrical vehicle drive motor disposed on said second vehicle body, means mechanically coupling said drive motor to said second road wheels, and means connected between said generator and said vehicle drive motor for transmitting electrical power from said generator to said vehicle drive motor.

37. A pavement-reconditioning vehicle comprising:

a front vehicle body riding on at least a pair of front road wheels and a second vehicle body riding on at least a pair of second road wheels, said front vehicle body and second vehicle body being coupled together by pivot means which enable pivoting movement of said front vehicle body relative to said second vehicle body about a vertical axis, microwave energy-generating means disposed on one of said vehicle bodies, microwave energy-emitting means carried on said front vehicle body for directing said microwave energy downwardly into pavement underlying said front vehicle body within a predetermined microwave region at the underside of said front vehicle body, said emitting means being spaced above said pavement to enable travel of said vehicle along said pavement while microwave energy is being directed thereto, microwave energy-trapping means disposed on said front vehicle body adjacent said microwave region for suppressing outward propagation of microwave energy therefrom as said vehicle travels along said pavement, remixing means carried on said second vehicle body for remixing heated pavement underlying said second vehicle body, an electrical generator carried on said second vehicle body, a fuel-consuming engine carried on said second vehicle body and being coupled to said generator to drive said generator, electrical conductor means coupling said generator to said microwave energy-generating means, and wherein said remixing means includes a rotary tiller, means carried on said second vehicle body and coupled to said rotary tiller for selectively raising and lowering said rotary tiller, an electrical tiller drive motor mechanically coupled to said tiller and energized by electrical power from said generator.

38. A vehicle for repairing asphaltic pavement comprising:

a frame riding on ground-engaging means for enabling travel along said pavement, at least one component of said ground engaging means being a compactor roller journaled to said frame, an electrical generator carried on said vehicle, an engine carried on said vehicle and driving said generator, microwave energy source means carried on said vehicle and coupled to said generator to receive electrical power therefrom, microwave-emitting means carried on said vehicle for directing microwave energy from said source into pavement beneath said vehicle, said microwave-emitting means being spaced above said pavement to enable travel of said vehicle along said pavement while said microwave energy is being directed thereto, microwave energy-trapping means secured to said vehicle for suppressing outward propagation of microwave energy therefrom while traveling along said pavement, remixing means disposed on said vehicle for remixing heated pavement beneath said vehicle, an electrical vehicle drive motor, rotary drive-transmitting means coupling said vehicle drive motor to said compactor roller to enable said roller to propel said vehicle along said pavement, and conductor means connected between said generator and said vehicle drive motor for transmitting electrical power from said generator to said vehicle drive motor.

39. An asphalt pavement-recycling apparatus comprising:

a microwave energy applicator vehicle having ground-engaging means for enabling travel along said pavement, said applicator vehicle having a microwave energy-generating source and means for directing microwave energy from said source downwardly into pavement beneath said applicator vehicle, at least one motor generator set carried on said apparatus, said motor generator set being of the form producing electrical power and producing hot exhaust gas, means connected between said motor generator set and said microwave energy source for transmitting electrical power from said motor generator set to said microwave energy source, a paver vehicle disposed behind said microwave applicator vehicle for travel along said pavement behind said applicator vehicle, said paver having a first conveyor means for picking up pavement constituents from the surface in front of said paver, means for depositing said pavement constituents in a layer on the surface over which said paver is traveling, and means for compacting said deposited layer of pavement constituents, and gas conduit means coupled between said motor generator set and said paver vehicle for transmitting at least a portion of said hot exhaust gas from said motor generator set to said pavement constituents within said paver vehicle.

40. The apparatus of claim 39 wherein said means for compacting said deposited layer of pavement constituents is a screed carried at the underside of said paver vehicle and wherein said gas conduit means directs a portion of said hot exhaust gas to said screed to maintain said screed in a heated condition.

41. The apparatus of claim 39 wherein said paver vehicle has a hopper for receiving said pavement constituents from said first conveyor means, further comprising means forming a cover over said first conveyor means and said hopper and wherein said gas conduit means delivers at least a portion of said hot exhaust gas to the region within said cover.

42. The apparatus of claim 39 wherein said gas conduit means transmits a portion of said hot exhaust gas to said pavement beneath said applicator vehicle.

43. The apparatus of claim 39 further comprising a motor-driven supplementary mixing means disposed on said paver vehicle in the path of pavement constituents through said paver vehicle.

44. The apparatus of claim 39 further comprising a self-propelled towing vehicle disposed in front of said microwave applicator vehicle and coupled thereto to tow said microwave applicator vehicle, said motor generator set being carried on said towing vehicle, and wherein said gas conduit means extends from said towing vehicle to said paver vehicle, at least a portion of said gas conduit means being flexible.

45. A method for heating pavement at a paved surface comprising:

positioning microwave energy emitting means above said surface in spaced relationship therefrom to provide a gap therebetween which enables travel of said means without direct contact with said surface, generating heat within said pavement below the surface thereof by directing microwave energy downwardly from said microwave energy emitting means into said pavement while traveling therealong, including dispersing said microwave energy substantially uniformly across a zone of said pavement which extends transversely with respect to the direction of travel therealong to cause a substantially uniform temperature rise across said zone of pavement, and blocking the sideward and forward and backward escape of microwave energy though the gap between said microwave energy region emitting means and said pavement while traveling therealong, at least in part by reflecting the upwardly directed component of outwardly propagating microwave energy in a downward direction to cause absorption of the reflected energy within the underlying surface thereby causing a progressive attenuation of microwave energy intensity in the outward direction within said gap.

46. Apparatus for heating pavement in place on a paved surface while traveling along said surface comprising:

microwave applicator means for establishing an electrically conductive microwave energy barrier above an area of said pavement, said applicator means being spaced apart from said pavement by a gap, means coupled to said applicator means for traveling said microwave applicator means along said surface without direct contact of said applicator means with said surface, means carried on said apparatus for generating microwave energy, means coupled to said generating means for releasing micorwave energy from said generating means into said pavement within the region between said barrier and said area of pavement and for distributing said energy substantially uniformly across a zone of said pavement extending transversely with respect to the direction of travel of said apparatus, and microwave trapping means secured to said applicator means for blocking the forward, backward and sideward escape of microwave energy from said region through the gap between said applicator means and said pavement while traveling therealong, said trapping means including at least one electrically conductive microwave reflector element extending outward from said applicator means above said gap in position for reflecting the upwardly directed component of microwave energy, which is propagating through said gap, downwardly for absorption within the underlying surface.

47. The apparatus of claim 46 wherein said electrically conductive microwave reflector element is positioned to slant downward and outward from said applicator means at said gap to contact said surface and is flexible to accommodate to irregularities in said surface.

48. Apparatus for heating pavement in place on a paved surface while traveling along said surface comprising:

microwave applicator means forming an electrically conductive microwave energy barrier above an area of said pavement, means coupled to said applicator means for traveling said microwave applicator means along said surface, means carried on said apparatus for generating microwave energy, means coupled to said generating means for releasing microwave energy from said generating means into the region between said barrier and said area of pavement, means secured to said applicator means for blocking the escape of microwave energy from said region at the interface between said barrier means and said pavement while traveling therealong, wherein said means for blocking the escape of microwave energy comprises an electrically lossy substance disposed in the path of microwave energy which propagates outwardly from said region at said interface.

* * * * *